US010065087B2

(12) United States Patent
Sander et al.

(10) Patent No.: US 10,065,087 B2
(45) Date of Patent: Sep. 4, 2018

(54) GOLF CLUB SET HAVING SIMILAR PROPERTIES

(71) Applicant: NIKE, Inc., Beaverton, OR (US)

(72) Inventors: Raymond J. Sander, Benbrook, TX (US); Robert M. Boyd, Flower Mound, TX (US); John T. Stites, Sallisaw, OK (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/721,720

(22) Filed: May 26, 2015

(65) Prior Publication Data

US 2016/0346635 A1 Dec. 1, 2016

(51) Int. Cl.
*A63B 53/04* (2015.01)
*A63B 53/00* (2015.01)

(52) U.S. Cl.
CPC ..... *A63B 53/047* (2013.01); *A63B 53/00* (2013.01); *A63B 53/0466* (2013.01); *A63B 2053/005* (2013.01); *A63B 2053/0408* (2013.01)

(58) Field of Classification Search
CPC ..... A63B 2053/005; A63B 53/047; A63B 53/0466; A63B 2053/0408; A63B 53/00
See application file for complete search history.

(56) References Cited

U.S. PATENT DOCUMENTS 3,473,370 A 10/1969 Marciniak
3,984,103 A 10/1976 Nix
4,280,700 A 7/1981 Plagenhoef
4,679,791 A 7/1987 Hull
4,754,970 A 7/1988 Kobayashi
4,784,390 A * 11/1988 Horgen ..... A63B 53/00 434/252
4,923,197 A 5/1990 Schacht
5,121,918 A 6/1992 Teramoto et al.
5,228,688 A * 7/1993 Davis ..... A63B 53/00 473/290
5,333,859 A 8/1994 Teramoto et al.
5,377,978 A * 1/1995 Lee ..... A63B 53/00 473/291
5,595,547 A * 1/1997 Lekavich ..... A63B 53/00 473/287
5,885,166 A * 3/1999 Shiraishi ..... A63B 53/00 473/291
6,089,990 A * 7/2000 Kimura ..... A63B 53/047 473/290

(Continued)

FOREIGN PATENT DOCUMENTS

JP 09308710 A * 12/1997
JP 2001259092 A * 9/2001
WO 2012023857 A1 2/2012

OTHER PUBLICATIONS

Irons and Wedges, One Iron Golf System, from 1 Iron Golf website: http://www.1irongolf.com/index_files/golf_equipment_clubs_2.htm , last visited Nov. 10, 2015).

(Continued)

*Primary Examiner* — Stephen Blau

(57) ABSTRACT

A set of ball striking devices, such as a set golf clubs, having similar characteristics between clubs within the set of clubs such as length, weight, and lie angle. Characteristics can include lengths and lie angle.

7 Claims, 22 Drawing Sheets

(56) References Cited

U.S. PATENT DOCUMENTS

| | | | | |
|---|---|---|---|---|
| 6,110,056 | A | 8/2000 | Yamamoto | |
| 6,478,689 | B1 | 11/2002 | Hisamatsu | |
| 7,137,903 | B2 * | 11/2006 | Best | A63B 53/047 473/290 |
| 7,166,042 | B2 * | 1/2007 | Gilbert | A63B 53/047 473/291 |
| 7,396,290 | B2 * | 7/2008 | Gilbert | A63B 53/047 473/290 |
| 7,500,926 | B2 * | 3/2009 | Rae | A63B 53/0466 473/345 |
| 7,955,187 | B2 | 6/2011 | Bone et al. | |
| 8,070,621 | B2 * | 12/2011 | Nakano | A63B 53/0466 473/290 |
| 8,133,133 | B2 * | 3/2012 | Gilbert | A63B 53/04 473/312 |
| 8,246,488 | B2 * | 8/2012 | Stevens | A63B 53/04 473/335 |
| 8,360,899 | B2 | 1/2013 | Swartz et al. | |
| 8,360,903 | B2 | 1/2013 | Carlyle et al. | |
| 8,371,962 | B2 | 2/2013 | Solheim et al. | |
| 8,409,029 | B2 | 4/2013 | Abe | |
| 8,740,721 | B2 * | 6/2014 | Yamamoto | A63B 53/047 473/312 |
| 9,186,561 | B2 * | 11/2015 | Schweigert | A63B 53/08 |
| 9,333,400 | B2 * | 5/2016 | Girard | A63B 53/02 |
| 9,364,725 | B2 * | 6/2016 | Hettinger | A63B 53/0466 |
| 9,387,372 | B2 * | 7/2016 | Hayashi | A63B 53/0466 |
| 2009/0088276 | A1 | 4/2009 | Solheim et al. | |
| 2009/0131189 | A1 | 5/2009 | Swartz et al. | |
| 2009/0286617 | A1 * | 11/2009 | Voges | A63B 53/14 473/300 |
| 2009/0326688 | A1 | 12/2009 | Thomas et al. | |
| 2010/0151956 | A1 | 6/2010 | Swartz et al. | |
| 2013/0225311 | A1 * | 8/2013 | Clausen | A63B 53/06 473/290 |
| 2014/0228143 | A1 * | 8/2014 | Roach | A63B 53/047 473/291 |
| 2015/0151175 | A1 * | 6/2015 | Lytle | A63B 53/047 473/291 |

OTHER PUBLICATIONS

Driver and Woods, One Iron Golf System from 1 Iron Golf website: www.1irongolf.com/index_files/golf_equipment_clubs_4.htm, last visited Nov. 10, 2015.

Sep. 9, 2016—(WO) ISR & WO—App. No. PCT/US16/33992.

Golf Club Technology: "Replacement of Your Long Irons with a Set of Single Length Golf Hybrids", May 7, 2015 (May 7, 2015) XP002761078, Retrieved from the Internet: URL:https://web.archive.org/web/20150507152546/http://www.golfclub-technology.com/golfhybrids.html [retrieved on Aug. 24, 2016] the whole document.

* cited by examiner

GOLF CLUB SET HAVING SIMILAR PROPERTIES

TECHNICAL FIELD

The invention relates generally to a set of ball striking devices, such as a set of golf clubs, and more particularly to a set of golf clubs having similar properties between clubs of the set of clubs, such as club length.

BACKGROUND

Golf is enjoyed by a wide variety of players—players of different genders, and players of dramatically different ages and skill levels. These factors, together with increased golf programming on television (e.g., golf tournaments, golf news, golf history, and/or other golf programming) and the rise of well-known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Typically a set of golf clubs includes 14 clubs. A set generally includes a putter, 3-4 wood-type clubs, and 9-10 iron-type clubs. Each of the clubs generally has different characteristics such as length, weight, stiffness, etc. These different characteristics require a golfer to learn a different swing for each golf club in the set of golf clubs. Generally, as one moves from a driver to a sand wedge, each club becomes progressively shorter and heavier which means a golfer's swing can vary significantly as he (or she) changes clubs.

In some cases a set of irons is produced to have a similar swing weight for each club. Swing weight is a measurement of how heavy a club feels to a player swinging the club. Measurement of swing weight is determined by the moment generated by the club about a fulcrum point usually 12 or 14 inches from the base (or grip end) of the golf club. The swing weight generally increases as the weight of the club head increases or the club length increases.

Learning to play golf can be very daunting for a beginning golfer. Learning to develop a repeatable golf swing in order can hit a ball with similar results is itself very difficult, and learning to swing a club that is slightly different from the next one within the set can add to this difficulty. The difficulty in learning golf can be a reason many potential players do not fully engage in the sport of golf.

The present disclosure addresses the problems discussed above and other problems, and provides advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to a set of golf clubs, each golf club having a golf club head and a shaft.

According to one aspect, a set of golf clubs can include at least one wood-type golf club having a wood-type golf club head having a striking face configured for striking a ball and a body extending rearwardly from the striking face, the body having a crown, a sole, a heel, and a toe, and a hosel including a hosel axis; and a shaft configured to engage with the wood-type golf club head. The at least one wood-type club can have a first length, a first lie angle, a first weight, a first swing weight, and a first center of gravity; and the at least one wood-type club can have a ground plane origin point located at the point at which a ground plane and the hosel axis intersect. The set of golf clubs can include at least one hybrid-type golf club having a hybrid-type golf club head having a striking face configured for striking a ball and a body extending rearwardly from the striking face, the body having a crown, a sole, a heel, and a toe, and a hosel including a hosel axis; and a shaft configured to engage with the hybrid-type golf club head. The at least one hybrid-type club can have a second length, a second lie angle, a second weight, a second swing weight, and a second center of gravity; and the at least one hybrid-type club can have a ground plane origin point located at the point at which a ground plane and the hosel axis intersect. The set of golf clubs can include at least one iron-type golf club having an iron-type golf club head having a striking face configured for striking a ball and a body extending rearwardly from the striking face, the body having a top surface, a sole, a heel, and a toe, and a hosel including a hosel axis; and a shaft configured to engage with the iron-type golf club head. The at least one iron-type club can have a third length, a third lie angle, a third weight, a third swing weight, and a third center of gravity; and the at least one iron-type club has a ground plane origin point located at the point at which a ground plane and the hosel axis intersect. The first, second, and third lengths can be substantially equal; and the first, second, and third lie angles can be substantially equal.

According to another aspect, a set of golf clubs can include a plurality of hybrid-type golf clubs, each hybrid-type golf club having a hybrid-type golf club head having a striking face configured for striking a ball and a body extending rearwardly from the striking face, the body having a crown, a sole, a heel, and a toe, and a hosel including a hosel axis; and a shaft configured to engage with the hybrid-type golf club head. Each of the plurality of hybrid-type golf clubs can have a first length, a first lie angle, a first weight, a first swing weight, and a first center of gravity, and a hosel including a hosel axis. Each of the plurality of hybrid-type clubs include ground plane origin point located at the point at which a ground plane and the hosel axis intersect. Each of the plurality of hybrid-type clubs can have a loft angle in the range of 21 degrees to 32 degrees. The set of golf clubs can include a plurality of iron-type golf clubs, each iron-type golf club having an iron-type golf club head having a striking face configured for striking a ball and a body extending rearwardly from the striking face, the body having a top surface, a sole, a heel, and a toe, and a hosel including a hosel axis; and a shaft configured to engage with the iron-type golf club head. Each of the plurality of iron-type golf clubs can have a second length, a second lie angle, a second weight, a second swing weight, and a second center of gravity. Each of the plurality of iron-type clubs includes a ground plane origin point located at the point at which the ground plane and the hosel axis intersect. Each of the plurality of iron-type clubs can have a loft angle in the range of 23 degrees to 60 degrees. The first, and second length can be substantially equal; and the first, and second lie angle can be substantially equal.

In another aspect, a set of golf clubs can include a plurality of wood-type golf clubs, each wood-type golf club having a wood-type golf club head having a striking face configured for striking a ball and a body extending rearwardly from the striking face, the body having a crown, a sole, a heel, and a toe, and a hosel including a hosel axis; and a shaft configured to engage with the wood-type golf club head. Each of the wood-type golf clubs can have a substantially similar length, a substantially similar lie angle, a substantially similar weight, a substantially similar swing weight, and a substantially similar center of gravity; and each of the plurality of wood-type clubs can have a loft angle in the range of 7 degrees to 26 degrees.

In another aspect, a set of golf clubs can include a plurality of iron-type golf clubs, each iron-type golf club having an iron-type golf club head having a striking face configured for striking a ball and a body extending rearwardly from the striking face, the body having a top surface, a sole, a heel, and a toe, and a hosel including a hosel axis; and a shaft configured to engage with the iron-type golf club head. Each of the iron-type golf clubs can have a substantially similar length, a substantially similar lie angle, a substantially similar weight, a substantially similar swing weight, and a substantially similar center of gravity; and each of the plurality of iron-type clubs can have a loft angle in the range of 23 degrees to 60 degrees.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1A:
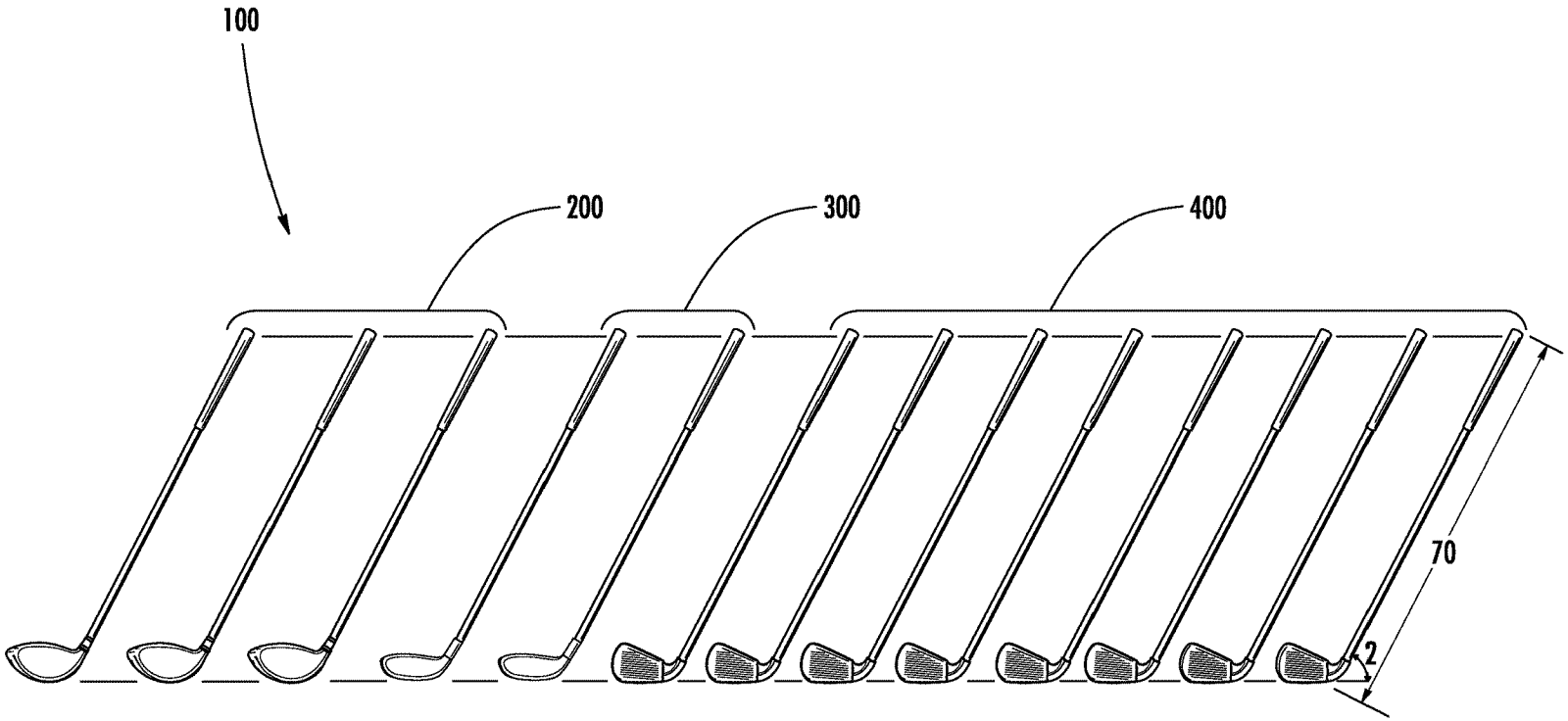
FIG. 1A is a front view of a set of wood-type golf clubs, hybrid-type golf clubs, and iron-type golf clubs, according to aspects of the disclosure.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this invention relate to sets of ball striking devices, such as a set of golf clubs, and the like. Such sets of ball striking devices, according to at least some examples of the invention, may include a ball striking head with a ball striking surface. In the case of a set of golf club, the ball striking surface is a substantially flat surface on one face of the ball striking head.

According to various aspects and embodiments, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys, metal matrix composites, and other metallic materials). It is understood that the head may contain components made of several different materials, including carbon-fiber composites, polymer materials, and other components. Additionally, the components may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

Figure 1B:
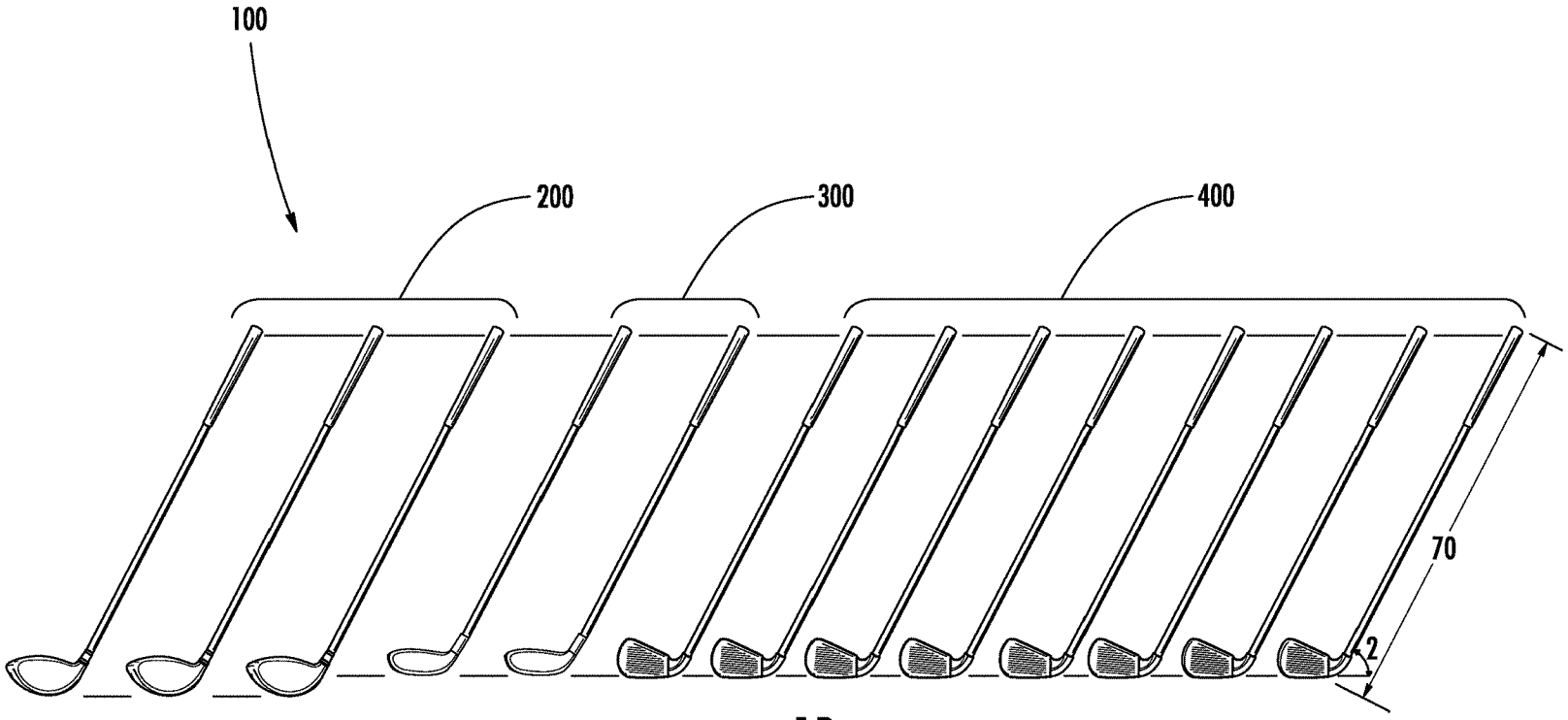
FIG. 1B is a front view of a set of wood-type golf clubs, hybrid-type golf clubs, and iron-type golf clubs, according to aspects of the disclosure.
Figure 1C:
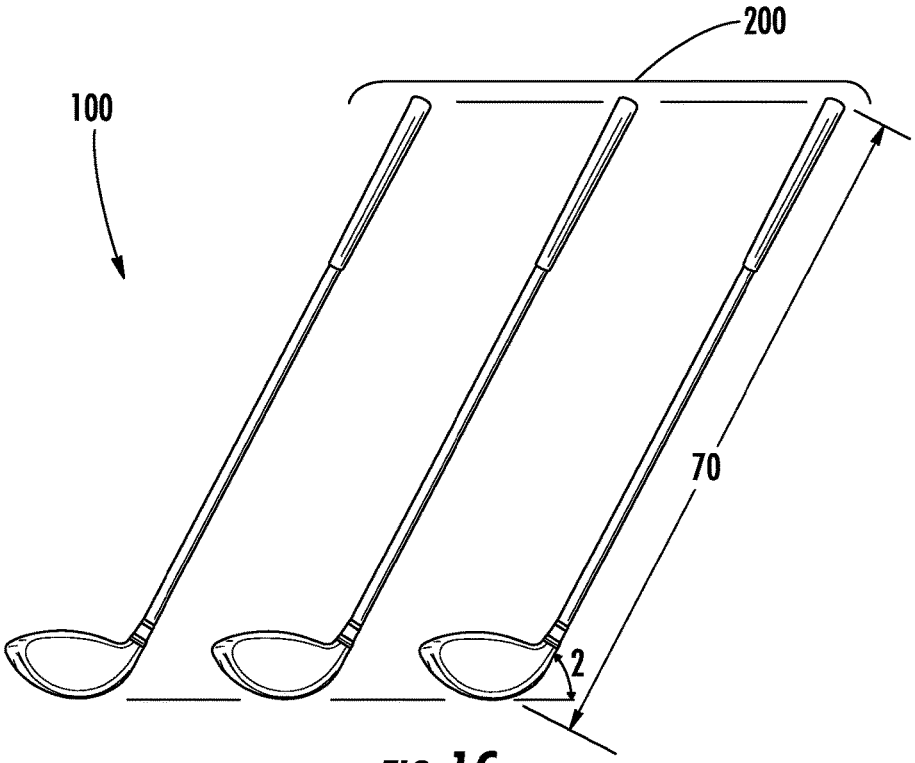
FIG. 1C is a front view of a set of wood-type golf clubs, according to aspects of the disclosure.
Figure 1D:
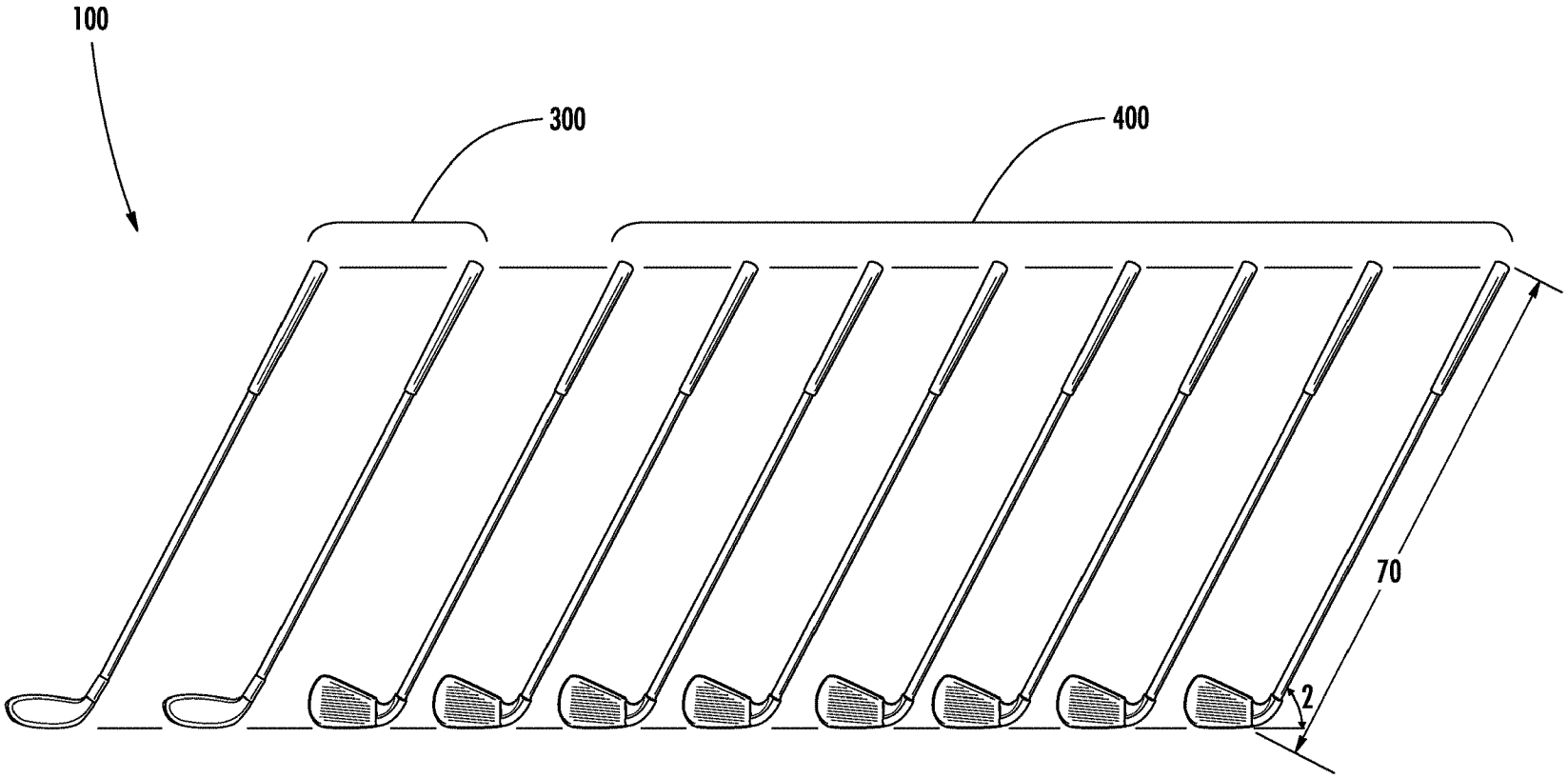
FIG. 1D is a front view of a set of hybrid-type golf clubs and iron-type golf clubs, according to aspects of the disclosure.
Figure 1E:
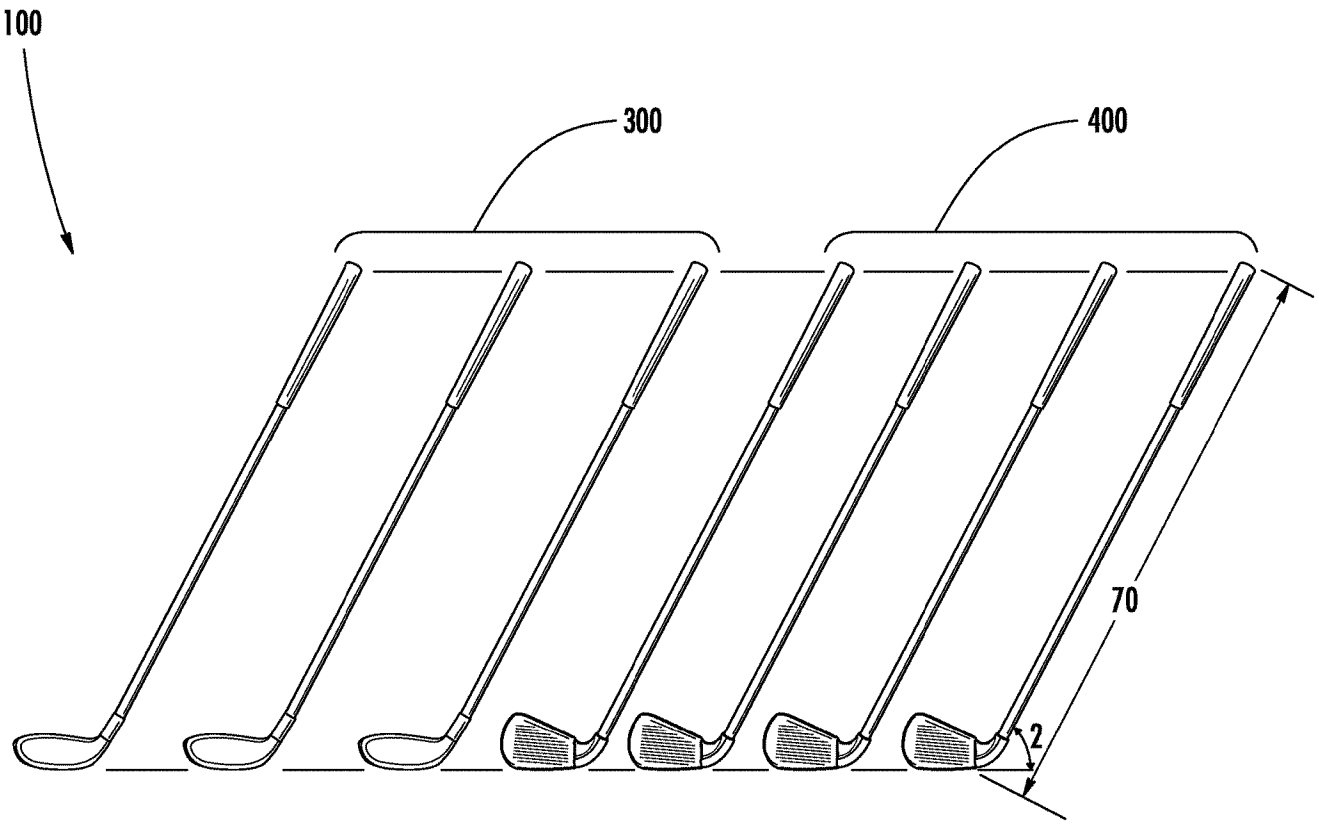
FIG. 1E is a front view of a set of hybrid-type golf clubs and iron-type golf clubs, according to aspects of the disclosure.
Figure 1F:
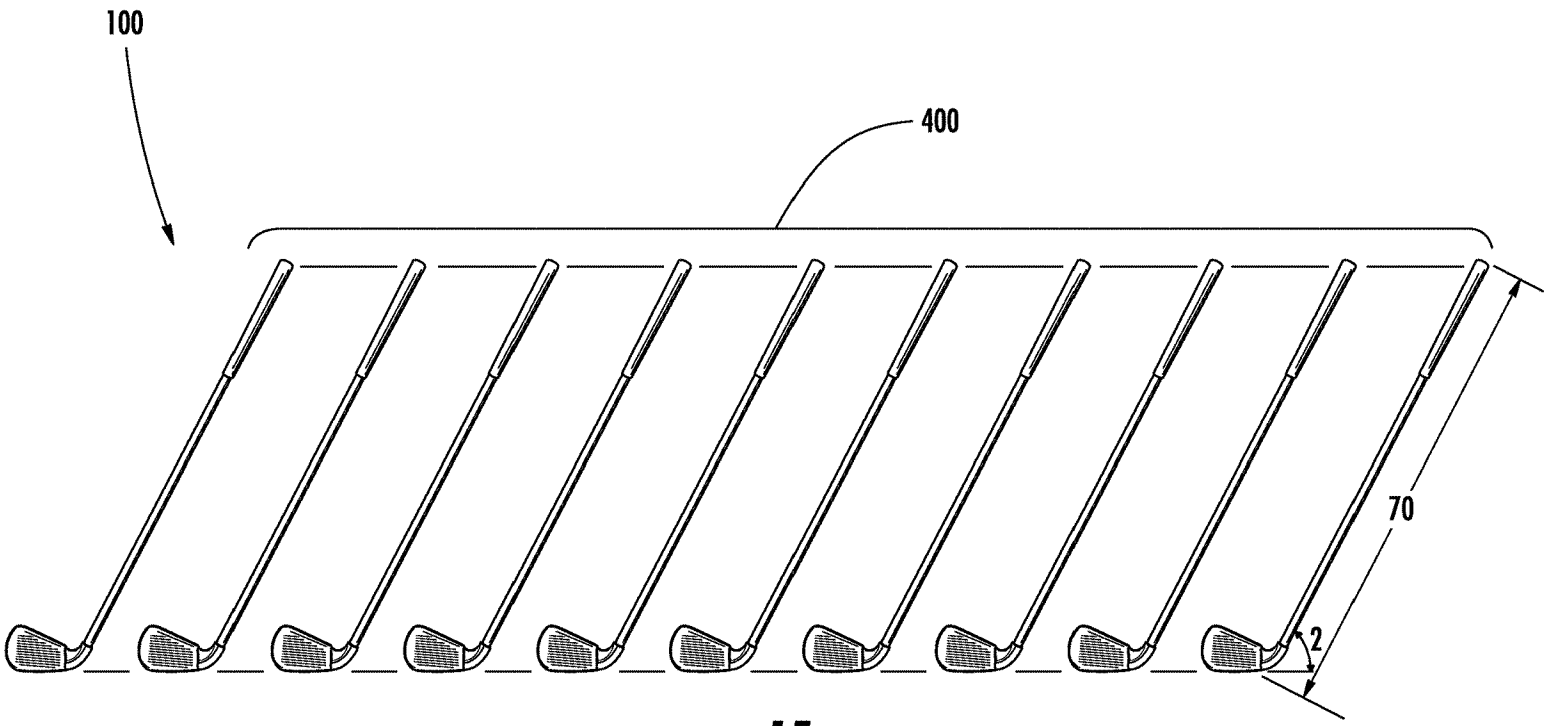
FIG. 1F is a front view of a set of iron-type golf clubs, according to aspects of the disclosure.

A set of golf clubs 100, as shown in FIGS. 1A-1F can include any number golf clubs and can include any number of different types of golf clubs including wood-type golf clubs, including fairway woods, hybrid-type clubs, iron-type clubs, and putters. As shown, for example, in FIG. 1A a set of golf clubs can include wood-type clubs 200, hybrid-type clubs 300, and iron-type clubs 400. Other example sets of golf clubs can include wood-type clubs 200, hybrid-type clubs 300, and iron-type clubs 400 as shown in FIG. 1B; only wood-type clubs 200 as shown in FIG. 1C; hybrid-type clubs 300 and iron-type clubs 400 as shown in FIG. 1D, hybrid-type clubs 300 and iron-type clubs as shown in FIGS. 1D and 1E, only iron-type clubs as shown in FIG. 1F, or any combination of wood-type clubs 200, hybrid-type clubs 300, and iron-type clubs 400.

As will be described in more detail below, any number of clubs within a set of golf clubs 100 can have similar characteristics between the clubs within the set of golf clubs 100. Such similarity between characteristics of the golf clubs can in some examples allow a user to more easily use the set of golf clubs 100. Such characteristics can include, for example, length of the golf clubs, lie angle of the golf clubs, weight of the golf clubs, swing weight of the golf clubs, location of center of gravity of the golf club heads, and the moments of inertia of the golf club heads.

At least some examples of a ball striking devices as described herein relate to golf clubs having head structures, including heads for wood-type golf clubs, such as drivers, fairway woods, hybrid clubs, iron-type clubs, and putters. Such devices may include a one-piece construction or a multiple-piece construction. Example structures of a set of ball striking devices according to this disclosure will be described in more detail below in conjunction with FIGS. 2-19 which illustrate embodiments of golf clubs that can be part of a set of golf clubs 100.

Woods-Type Clubs

As discussed above, a set of golf clubs 100 can include one or more wood-type golf club 200 which are shown and discussed in more detail in reference to FIGS. 2-8. A wood-type golf club 100 as shown in FIGS. 2-8 can be configured as a driver, a fairway wood and any other type of wood-type club. A wood-type golf club 200 includes a golf club head or a ball striking head 202 configured to strike a ball in use and a shaft 204 connected to the ball striking head 202 and extending therefrom. FIGS. 2-8 illustrate one embodiment of a ball striking head in the form of a golf club head 202 that has a striking face 212 connected to a body 208, with a hosel 209 extending therefrom and a shaft 204 connected to the hosel 209. For reference, the head 202 generally has a top or crown 216, a bottom or sole 218, a heel 220 proximate the hosel 209, a toe 222 distal from the hosel 209, a front 224, and a back or rear 226, as shown in FIGS. 2-8. The shape and design of the head 202 may be partially dictated by the intended use of the golf club 200. For example, it is understood that the sole 218 is configured to face the playing surface in use. With clubs that are configured to be capable of hitting a ball resting directly on the playing surface, such as a fairway wood, the sole 218 may contact the playing surface in use, and features of the club may be designed accordingly. In the club 200 shown in FIGS. 2-8, the head 202 has an enclosed volume, measured per "USGA PROCEDURE FOR MEASURING THE CLUB HEAD SIZE OF WOOD CLUBS", TPX-3003, REVISION 1.0.0 dated Nov. 21, 2003. In this procedure, the volume of the club head is determined using the displaced water weight method. According to the procedure, any large concavities must be filled with clay or dough and covered with tape so as to produce a smooth contour prior to measuring volume. Club head volume may additionally or alternately be calculated from three-dimensional computer aided design (CAD) modeling of the golf club head. In other applications, such as for a different type of golf club, the head 202 may be designed to have different dimensions and configurations. For example, when configured as a driver, the club head 202 may have a volume of at least 360 cc, of at least 400 cc, and in some structures, at least 450 cc, or even at least 470 cc. The head 102 illustrated in the form of a driver in FIGS. 2-8 has a volume of approximately 460 cc, however the volume can be approximately 360 cc to 470 cc. The head 202 can also be configured as a fairway wood which can have a volume of approximately 120 cc to 250 cc.

The body 208 of the head 202 can have various different shapes, including a rounded shape, as in the head 202 shown in FIGS. 2-8, a generally square or rectangular shape, or any other of a variety of other shapes. The shape of the club can be configured to distribute weight in any desired, manner, e.g., away from the face 212 and/or the geometric/volumetric center of the head 202, in order to create, for example, a lower center of gravity and/or a higher moment of inertia.

In the illustrative embodiment shown in FIGS. 2-8, the head 202 has a hollow structure defining an inner cavity 206 (e.g., defined by the face 212 and the body 208) with a plurality of inner surfaces defined therein. In one embodiment, the inner cavity 206 may be filled with air. However, in other embodiments, the inner cavity 206 could be filled or partially filled with another material, such as foam or hot melt. In still further embodiments, the solid materials of the head may occupy a greater proportion of the volume, and the head may have a smaller cavity or no inner cavity 206 at all. It is understood that the inner cavity 206 may not be completely enclosed in some embodiments.

Figure 8:
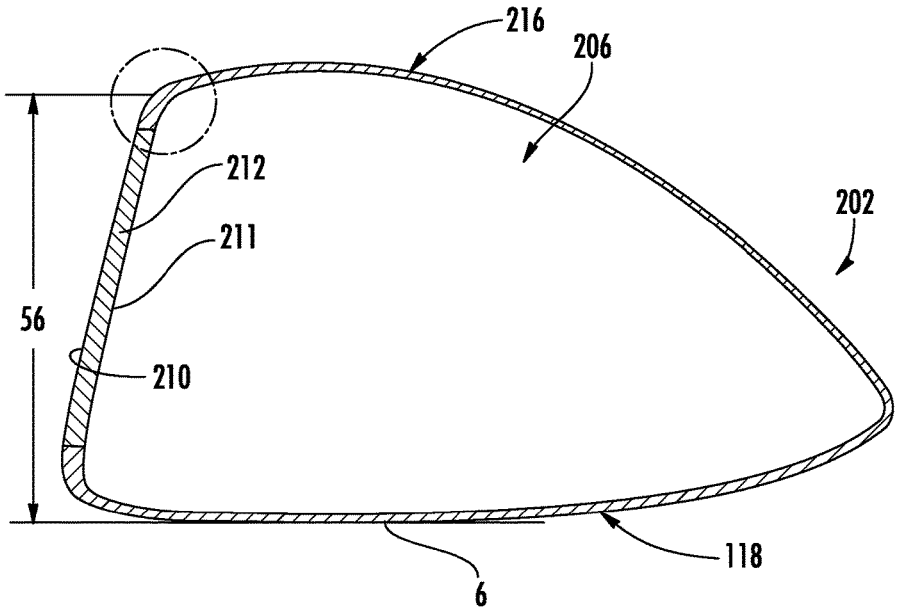
FIG. 8 is a cross-section view taken along line 8-8 of FIG. 6, with a magnified portion also shown.
Figure 9:
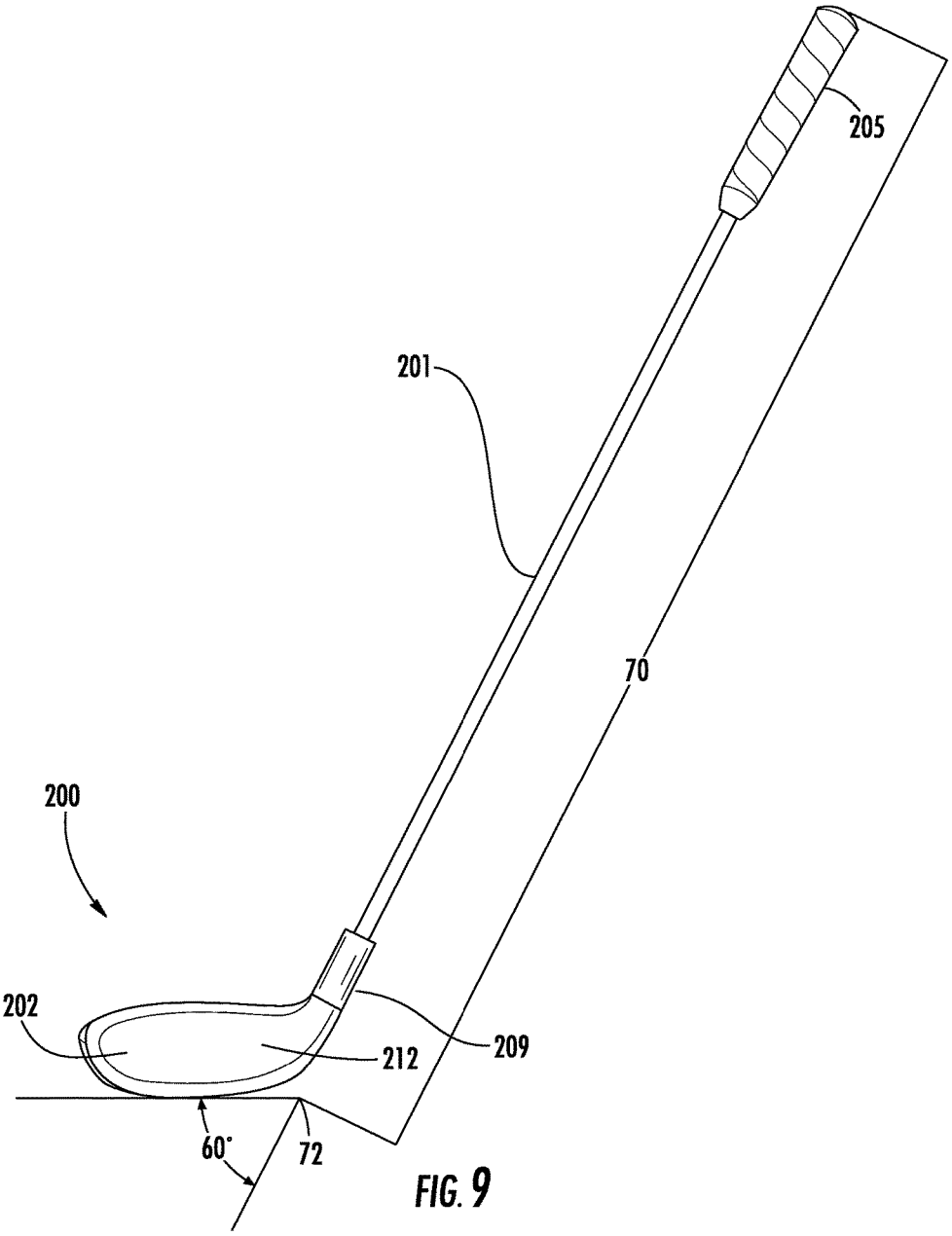
FIG. 9 is a front view of one embodiment of a hybrid-type golf club according to aspects of the disclosure.
Figure 10:
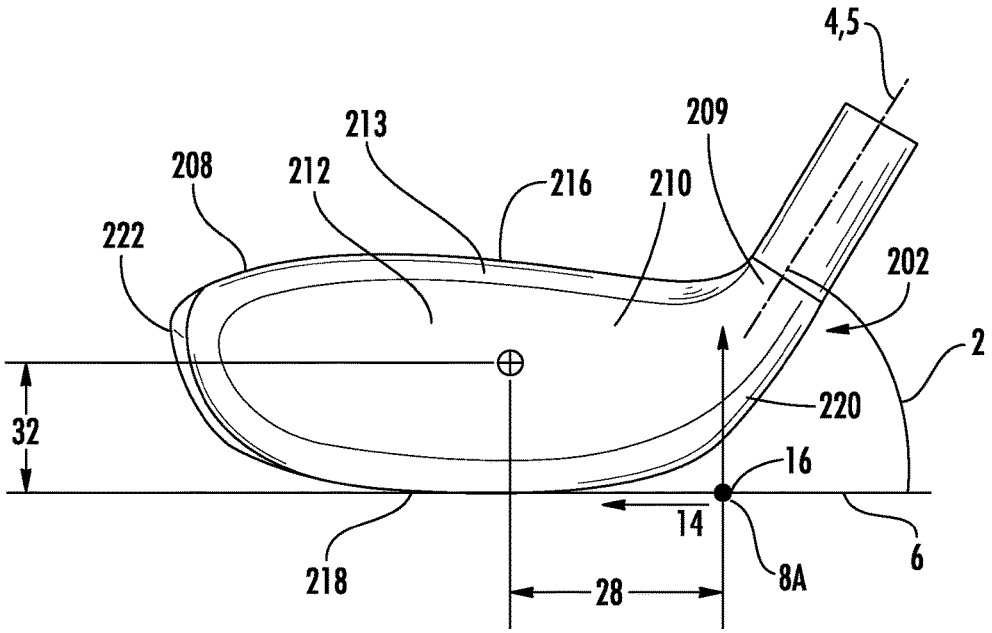
FIG. 10 is a front view of the club head of FIG. 9, showing a ground plane origin point.
Figure 11:
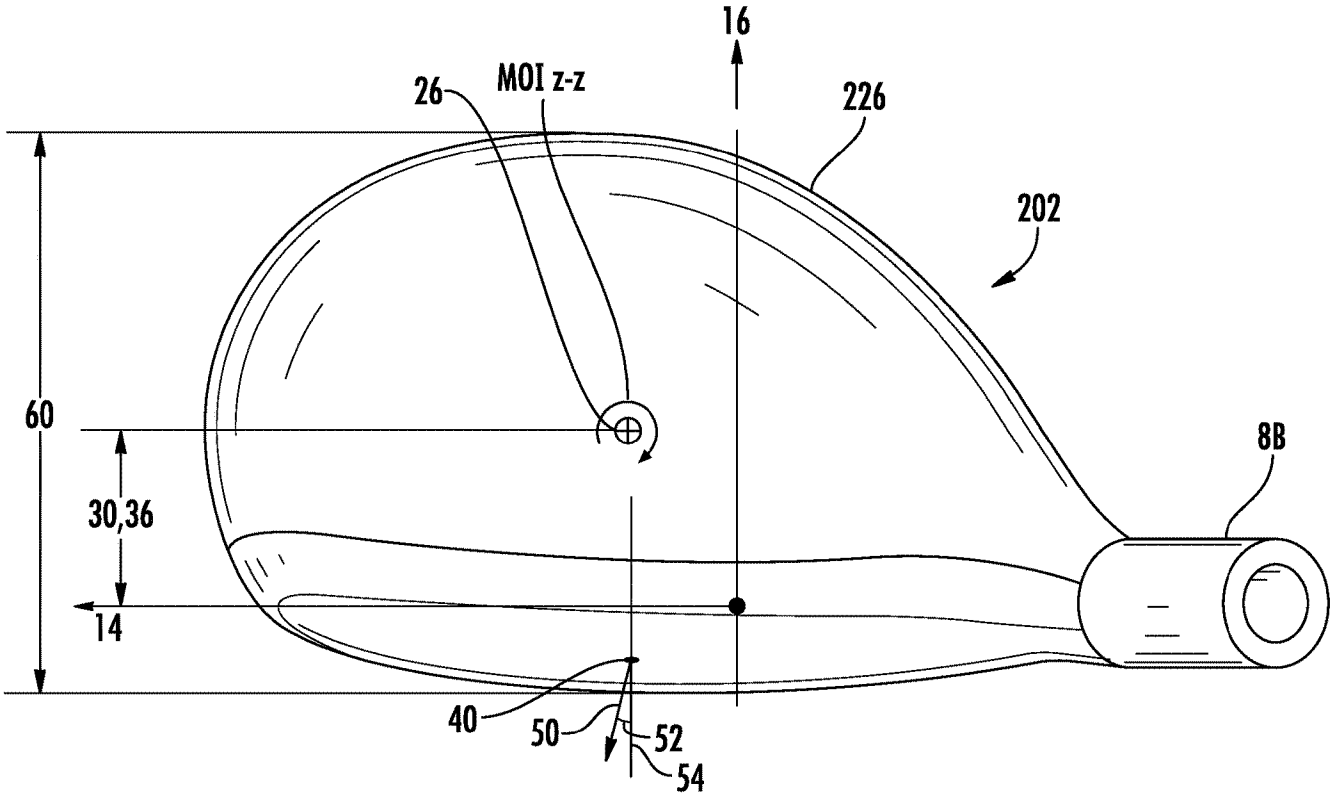
FIG. 11 is a top view of the club head of FIG. 9.
Figure 12:
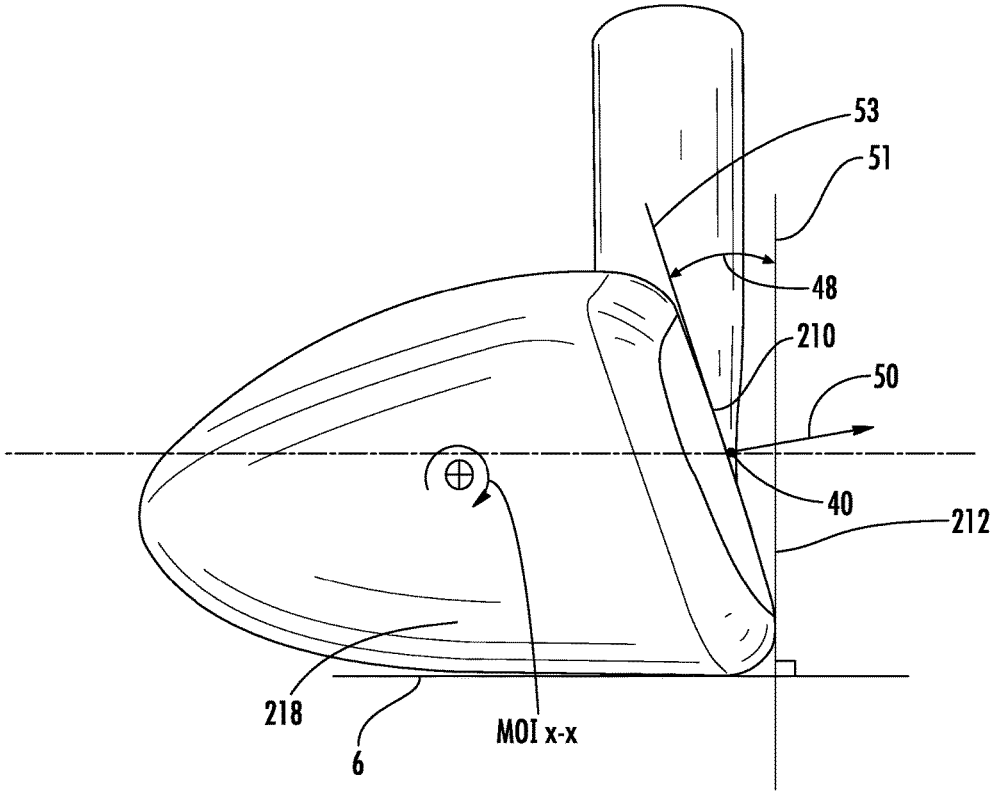
FIG. 12 is a side view of the club head of FIG. 9.

The face 212 is located at the front 224 of the head 202 and has a ball striking surface (or striking surface) 210 located thereon and an inner surface 211 opposite the ball striking surface 210, as illustrated in FIG. 8. The ball striking surface 210 is typically an outer surface of the face 212 configured to face a ball in use and is adapted to strike the ball when the golf club 200 is set in motion, such as by swinging. As shown, the ball striking surface 210 is relatively flat, occupying at least a majority of the face 212. The face 212 has an outer periphery formed of a plurality of outer or peripheral edges 213. The edges of the face 212 may be defined as the boundaries of an area of the face 212 that is specifically designed to contact the ball in use, and may be recognized as the boundaries of an area of the face 212 that is intentionally shaped and configured to be suited for ball contact. The face 212 may include some curvature in the top to bottom and/or heel to toe directions (e.g., roll and bulge characteristics), as is known and is conventional in the art. In other embodiments, the surface 210 may occupy a different proportion of the face 212, or the body 208 may have multiple ball striking surfaces 110 thereon. Generally, the ball striking surface 210 is inclined with respect to the ground or contact surface (i.e., at a loft angle), to give the ball a desired trajectory and spin when struck, and it is understood, and as will be discussed in more detail below, different club heads 102 may have different loft angles. Additionally, the face 212 may have a variable thickness and also may have one or more internal or external inserts and/or supports in some embodiments. In one embodiment, the face 212 of the head 202 may be made from titanium (e.g., Ti-6Al-4V alloy or other alloy); however, the face 212 may be made from a stainless steel or other materials in other embodiments.

It is understood that the face 212, the body 208, and/or the hosel 209 can be formed as a single piece or as separate pieces that are joined together. The face 212 may be formed as a face member with the body 208 being partially or wholly formed by one or more separate pieces connected to the face member. Such a face member may be in the form of, e.g., a face plate member or face insert, or a partial or complete cup-face member having a wall or walls extending rearward from the edges of the face 212. These pieces may be connected by an integral joining technique, such as welding, cementing, or adhesively joining. Other known techniques for joining these parts can be used as well, including many mechanical joining techniques, including releasable mechanical engagement techniques. As one example, a body member formed of a single, integral, cast piece may be connected to a face member to define the entire club head. The head 202 in FIGS. 2-8 may be constructed using this technique, in one embodiment. As another example, a single, integral body member may be cast with an opening in the sole. The body member is then connected to a face member, and a separate sole piece is connected within the sole opening to completely define the club head. Such a sole piece may be made from a different material, e.g., polymer or composite. As a further example, either of the above techniques may be used, with the body member having an opening on the top side thereof. A separate crown piece is used to cover the top opening and form part or the entire crown 216, and this crown piece may be made from a different material, e.g., polymer or composite. As yet another example, a first piece including the face 212 and a portion of the body 208 may be connected to one or more additional pieces to further define the body 208. For example, the first piece may have an opening on the top and/or bottom sides, with a separate piece or pieces connected to form part or all of the crown 216 and/or the sole 218. Further different forming techniques may be used in other embodiments.

Figure 2:
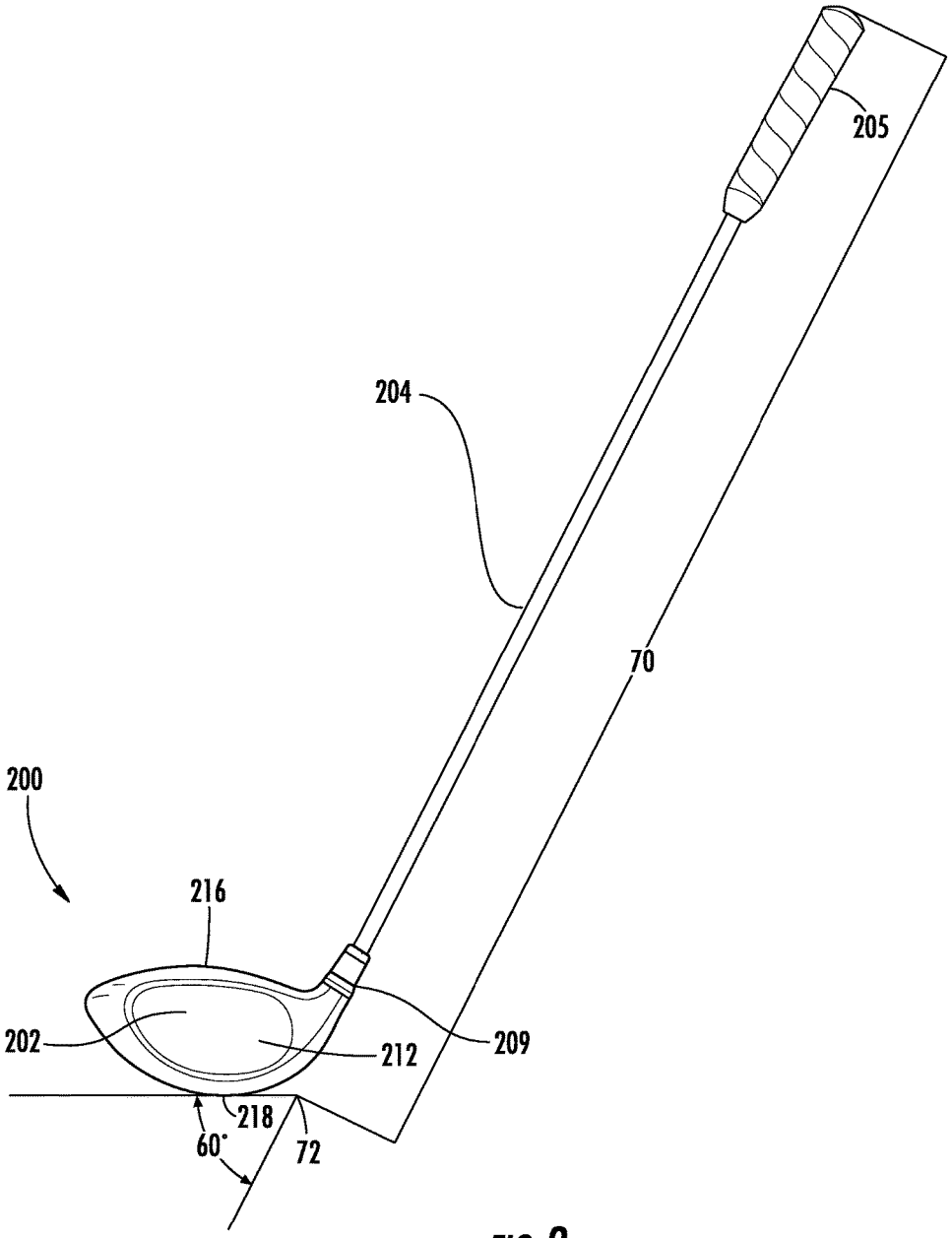
FIG. 2 is a front view of one embodiment of a wood-type golf club according to aspects of the disclosure.

The golf club 200 may include a shaft 204 connected to or otherwise engaged with the ball striking head 202 as shown in FIG. 2. The shaft 204 is adapted to be gripped by a user to swing the golf club 200 to strike the ball. The shaft 204 can be formed as a separate piece connected to the head 202, such as by connecting to the hosel 209, as shown in FIG. 2. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. The head 202 may have an opening or other access for the adjustable hosel 209 connecting structure that extends through the sole 218, as seen in FIGS. 2-8. In other illustrative embodiments, at least a portion of the shaft 204 may be an integral piece with the head 202, and/or the head 202 may not contain a hosel 209 or may contain an internal hosel structure. Still further embodiments are contemplated without departing from the scope of the invention.

The shaft 204 may be constructed from one or more of a variety of materials, including metals, ceramics, polymers, composites, or wood. In some illustrative embodiments, the shaft 204, or at least portions thereof, may be constructed of a metal, such as stainless steel or titanium, or a composite, such as a carbon/graphite fiber-polymer composite. However, it is contemplated that the shaft 204 may be constructed of different materials without departing from the scope of the invention, including conventional materials that are known and used in the art. A grip element 205 may be positioned on the shaft 204 to provide a golfer with a slip resistant surface with which to grasp the golf club shaft 204, as seen in FIG. 1. The grip element may be attached to the shaft 204 in any desired manner, including in conventional manners known and used in the art (e.g., via adhesives or cements, threads or other mechanical connectors, swedging/swaging, etc.).

The various embodiments of golf clubs 200 and/or golf club heads 202 described herein may include components that have sizes, shapes, locations, orientations, etc., that are described with reference to one or more properties and/or reference points. Several of such properties and reference points are described in the following paragraphs, with reference to FIGS. 2-8.

Figure 3:
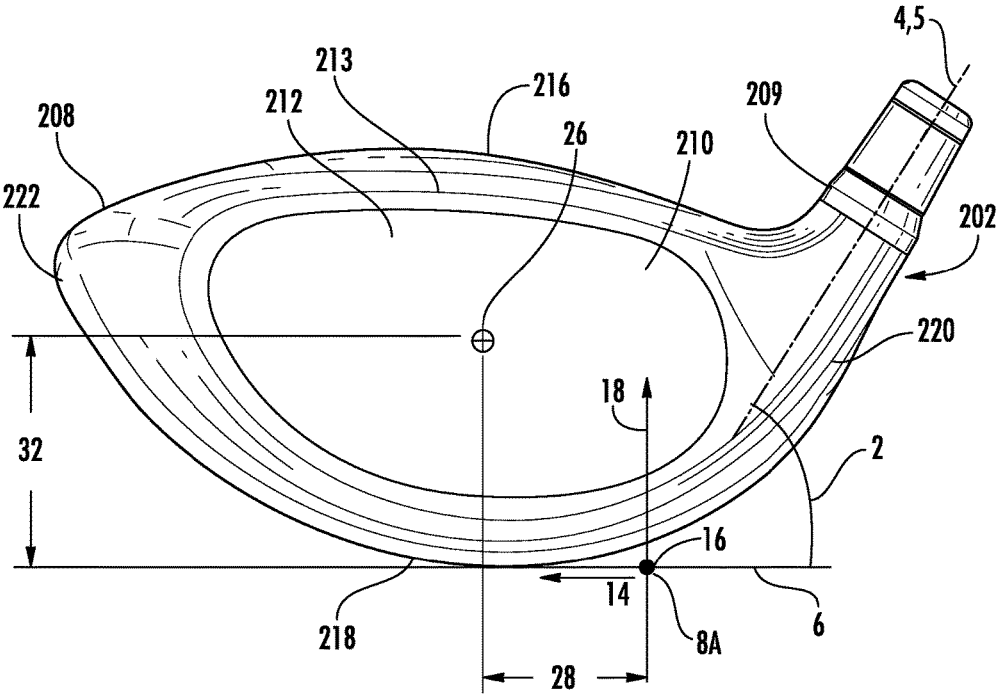
FIG. 3 is a front view of the club head of FIG. 2, showing a ground plane origin point.

As illustrated in FIG. 3, a lie angle 2 is defined as the angle formed between the hosel axis 4 or a shaft axis 5 and a horizontal plane contacting the sole 218, i.e., the ground plane 6. It is noted that the hosel axis 4 and the shaft axis 5 are central axes along which the hosel 209 and shaft 204 extend.

Figure 4:
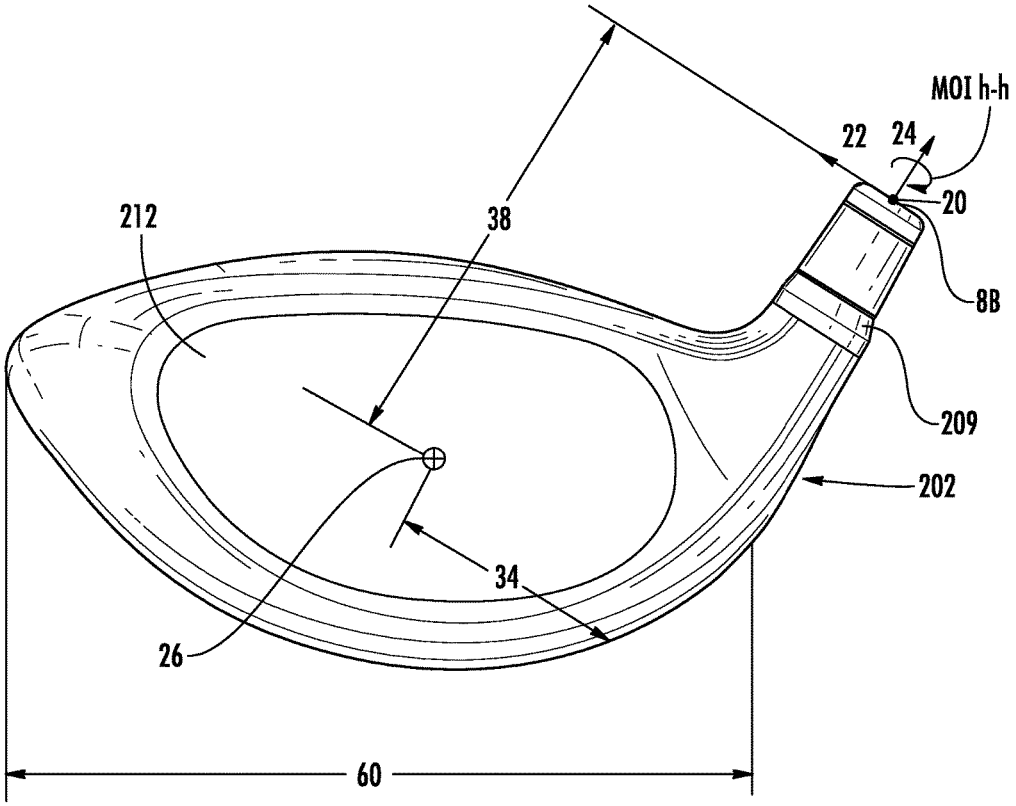
FIG. 4 is a front view of the club head of FIG. 2, showing a hosel origin point.

One or more origin points 8 (e.g., 8A, 8B) may be defined in relation to certain elements of the golf club 200 or golf club head 202. Various other points, such as a center of gravity, a sole contact, and a face center, may be described and/or measured in relation to one or more of such origin points 8. FIGS. 3 and 4 illustrate two different examples of such origin points 8, including their locations and definitions. A first origin point location, referred to as a ground plane origin point 8A is generally located at the ground plane 6. The ground plane origin point 8A is defined as the point at which the ground plane 6 and the hosel axis 4 intersect. A second origin point location, referred to as a hosel origin point 8B, is generally located on the hosel 209. The hosel origin point 8B is defined on the hosel axis 4 and coincident with the uppermost edge of the hosel 209. Either location for the origin point 8, as well as other origin points 8, may be utilized for reference without departing from this invention. It is understood that references to the ground plane origin point 8A and hosel origin point 8B are used herein consistent with the definitions in this paragraph, unless explicitly noted otherwise. Throughout the remainder of this application, the ground plane origin point 8A will be utilized for all reference locations, tolerances, calculations, etc., unless explicitly noted otherwise.

As illustrated in FIG. 3, a coordinate system may be defined with an origin located at the ground plane origin point 8A, referred to herein as a ground plane coordinate system. In other words, this coordinate system has an X-axis 14, a Y-axis 16, and a Z-axis 18 that all pass through the ground plane origin point 8A. The X-axis in this system is parallel to the ground plane and generally parallel to the striking surface 210 of the golf club head 202. The Y-axis 16 in this system is perpendicular to the X-axis 14 and parallel to the ground plane 6, and extends towards the rear 226 of the golf club head 202, i.e., perpendicular to the plane of the drawing sheet in FIG. 2. The Z-axis 18 in this system is perpendicular to the ground plane 6, and may be considered to extend vertically. Throughout the remainder of this application, the ground plane coordinate system will be utilized for all reference locations, tolerances, calculations, etc., unless explicitly noted otherwise.

Figure 5:
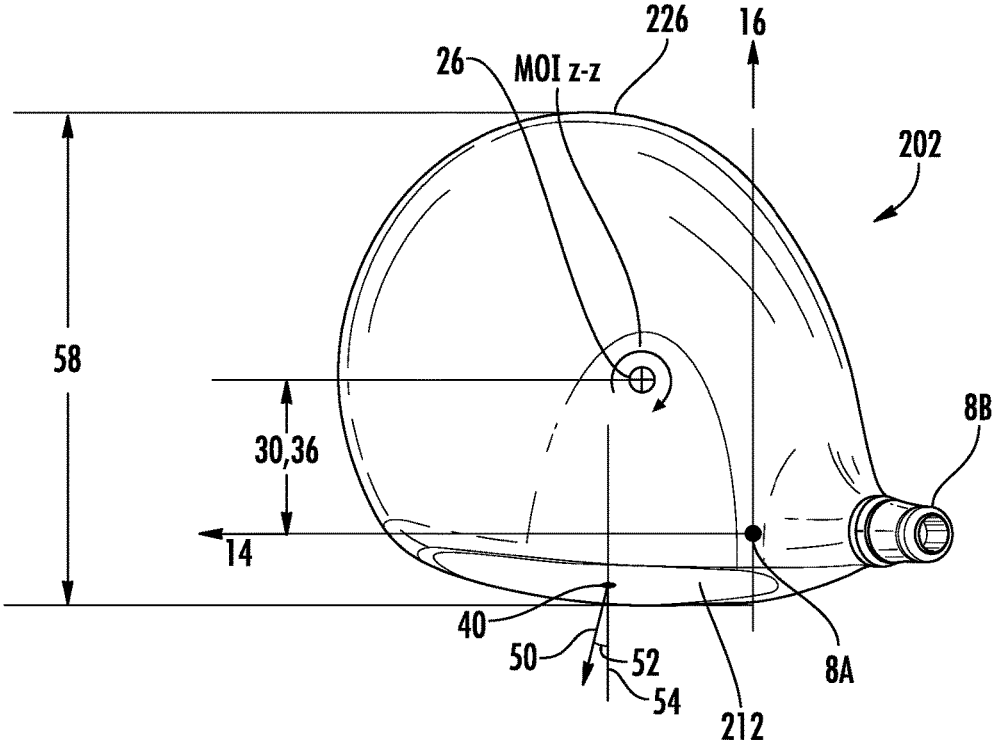
FIG. 5 is a top view of the club head of FIG. 2.

FIGS. 3 and 5 illustrate an example of a center of gravity location 26 as a specified parameter of the golf club head 202, using the ground plane coordinate system. The center of gravity of the golf club head 202 may be determined using various methods and procedures known and used in the art. The golf club head 202 center of gravity location 26 is provided with reference to its position from the ground plane origin point 8A. As illustrated in FIGS. 3 and 5, the center of gravity location 26 is defined by a distance CGX 28 from the ground plane origin point 8A along the X-axis 14, a distance CGY 30 from the ground plane origin point 8A along the Y-axis 16, and a distance CGZ 32 from the ground plane origin point 8A along the Z-axis 18.

Additionally as illustrated in FIG. 4, another coordinate system may be defined with an origin located at the hosel origin point 8B, referred to herein as a hosel axis coordinate system. In other words, this coordinate system has an X' axis 22, a Y' axis 20, and a Z' axis 24 that all pass through the hosel origin point 8B. The Z' axis 24 in this coordinate system extends along the direction of the shaft axis 5 (and/or the hosel axis 4). The X' axis 22 in this system extends parallel with the vertical plane and normal to the Z' axis 24. The Y' axis 20 in this system extends perpendicular to the X' axis 22 and the Z' axis 24 and extends toward the rear 126 of the golf club head 102, i.e., the same direction as the Y-axis 16 of the ground plane coordinate system.

FIG. 4 illustrates an example of a center of gravity location 26 as a specified parameter of the golf club head 102, using the hosel axis coordinate system. The center of gravity of the golf club head 102 may be determined using various methods and procedures known and used in the art. The golf club head 102 center of gravity location 26 is provided with reference to its position from the hosel origin point 8B. As illustrated in FIG. 4, the center of gravity location 26 is defined by a distance ΔX 34 from the hosel origin point 8B along the X' axis 22, a distance ΔY (not shown) from the hosel origin point 8B along the Y' axis 20, and a distance ΔZ 38 from the hosel origin point 8B along the Z' axis 24.

Figure 6:
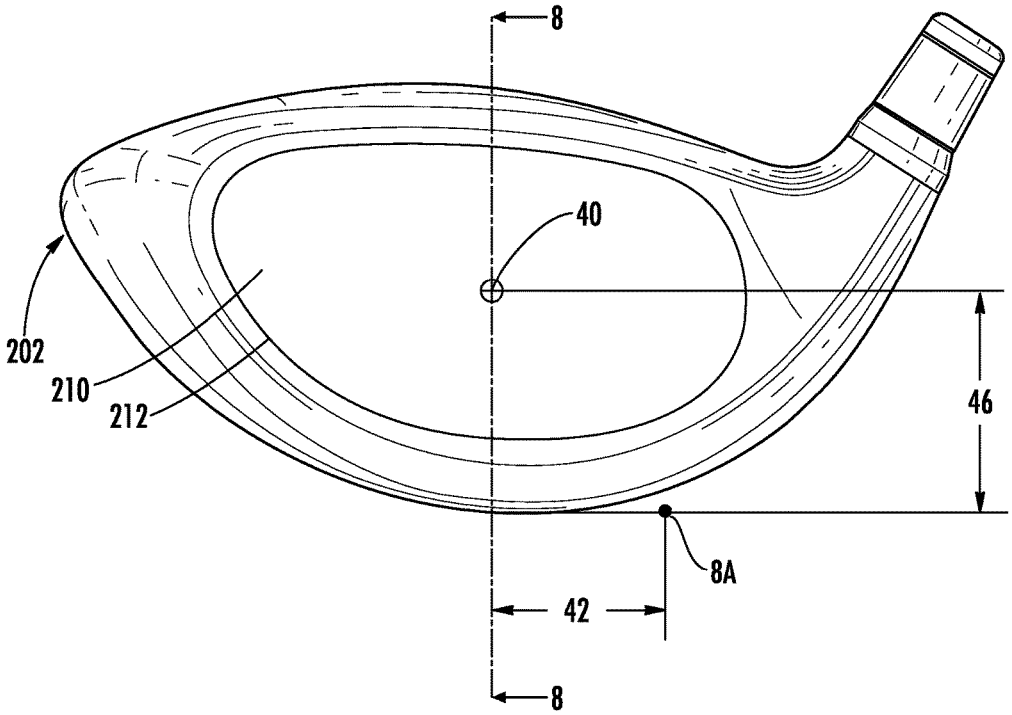
FIG. 6 is a front view of the club head of FIG. 2.

FIGS. 5 and 6 illustrate the face center (FC) location 40 on a golf club head 202. The face center location 40 illustrated in FIGS. 4 and 5 is determined using United States Golf Association (USGA) standard measuring procedures from the "Procedure for Measuring the Flexibility of a Golf Clubhead", USGA TPX-3004, Revision 2.0, Mar. 25, 2005. Using this USGA procedure, a template is used to locate the FC location 40 from both a heel 220 to toe 222 location and a crown 216 to sole 218 location. For measuring the FC location 40 from the heel to toe location, the template should be placed on the striking surface 210 until the measurements at the edges of the striking surface 210 on both the heel 220 and toe 222 are equal. This marks the FC location 40 from a heel to toe direction. To find the face center from a crown to sole dimension, the template is placed on the striking surface 210 and the FC location 40 from crown to sole is the location where the measurements from the crown 216 to sole 218 are equal. The FC location 40 is the point on the striking surface 210 where the crown to sole measurements on the template are equidistant, and the heel to toe measurements are equidistant.

As illustrated in FIG. 6, the FC location 40 can be defined from the ground plane origin coordinate system, such that a distance CFX 42 is defined from the ground plane origin point 8A along the X-axis 14, a distance CFY 44 is defined from the ground plane origin point 8A along the Y-axis 16, and a distance CFZ 46 is defined from the ground plane origin point 8A along the Z-axis 18. It is understood that the FC location 40 may similarly be defined using the hosel origin system, if desired.

Figure 7:
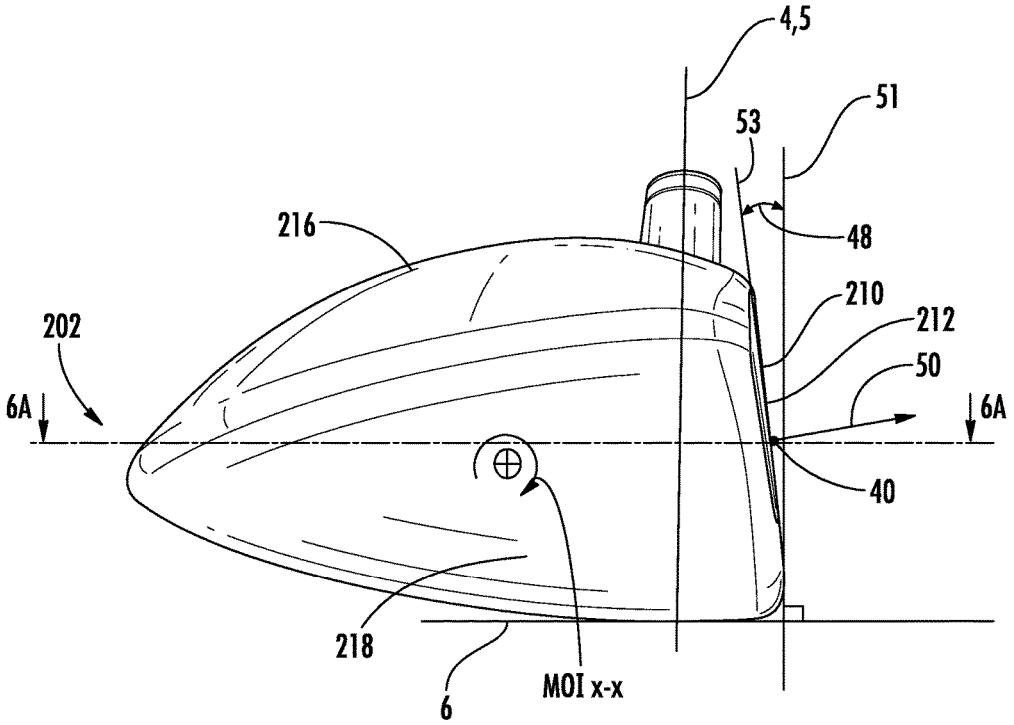
FIG. 7 is a side view of the club head of FIG. 2.

FIG. 7 illustrates an example of a loft angle 48 of the golf club head 202. The loft angle 48 can be defined as the angle between a plane 53 that is tangential to the striking surface 210 at the FC location 40 and an axis 51 normal or perpendicular to the ground plane 6. Alternately, the loft angle 48 can be defined as the angle between an axis 50 normal or perpendicular to the striking surface 210 at the FC location 40, called a face center axis 50, and the ground plane 6. It is understood that each of these definitions of the loft angle 48 may yield the substantially the same loft angle measurement.

FIG. 5 illustrates an example of a face angle 52 of a golf club head 102. As illustrated in FIG. 5, the face angle 52 is defined as the angle between the face center axis 50 and a plane 54 perpendicular to the X-axis 14 and the ground plane 6.

FIG. 3 illustrates a golf club head 102 oriented in a reference position. In the reference position, the hosel axis 4 or shaft axis 5 lies in a vertical plane, as shown in FIG. 7. As illustrated in FIG. 3, the hosel axis 4 may be oriented at the lie angle 2. The lie angle 2 selected for the reference position may be the golf club 200 manufacturer's specified lie angle. If a specified lie angle is not available from the manufacturer, a lie angle of 60 degrees can be used. Furthermore, for the reference position, the striking surface 210 may, in some circumstances, be oriented at a face angle 54 of 0 degrees. The measurement setup for establishing the reference position can be found determined using the "Procedure for Measuring the Club Head Size of Wood Clubs", TPX-3003, Revision 1.0.0, dated Nov. 21, 2003.

The moment of inertia is a property of the club head 202. There are three moment of inertia properties referenced herein. The moment of inertia with respect to an axis parallel to the X-axis 14 of the ground plane coordinate system, extending through the center of gravity 26 of the club head 202, is referenced as the MOI x-x, as illustrated in FIG. 7. The moment of inertia with respect to an axis parallel to the Z-axis 18 of the ground plane coordinate system, extending through the center of gravity 26 of the club head 202, is referenced as the MOI z-z, as illustrated in FIG. 5. The moment of inertia with respect to the Z' axis 24 of the hosel axis coordinate system is referenced as the MOI h-h, as illustrated in FIG. 4. The MOI h-h can be utilized in determining how the club head 102 may resist the golfer's ability to close the clubface during the swing.

The ball striking face height (FH) 56 is a measurement taken along a plane normal to the ground plane and defined by the dimension CFX 42 through the face center 40, of the distance between the ground plane 6 and a point represented by a midpoint of a radius between the crown 216 and the face 212. An example of the measurement of the face height 56 of a head 202 is illustrated in FIG. 8. It is understood that the club heads 202 described herein may be produced with multiple different loft angles, and that different loft angles may have some effect on face height 56.

For wood and hybrid type club heads, the head length 58 and head breadth 60 measurements can be determined by using the USGA "Procedure for Measuring the Club Head Size of Wood Clubs," USGA-TPX 3003, Revision 1.0.0, dated Nov. 21, 2003. Examples of the measurement of the head length 58 and head breadth 60 of a head 102 are illustrated in FIGS. 4 and 5.

The length 70 of the wood-type or hybrid-type golf club 200, 300 can be determined by using the USGA "Procedure for Measuring the Length of Golf Clubs," USGA-TPX 3002, Revision 1.0.0, dated Jan. 2, 2007. As shown in FIG. 2, the length 70 of the golf club 200, 300 is made with the club set on the horizontal ground plane 6 with the club head set at a 60 degree lie angle with the a plane parallel to the shaft and a face angle of 0 degrees. The length 70 of the golf club 200 is the distance from the point of the intersection 72 between the two planes to the end of the grip 205.

Figure 13:
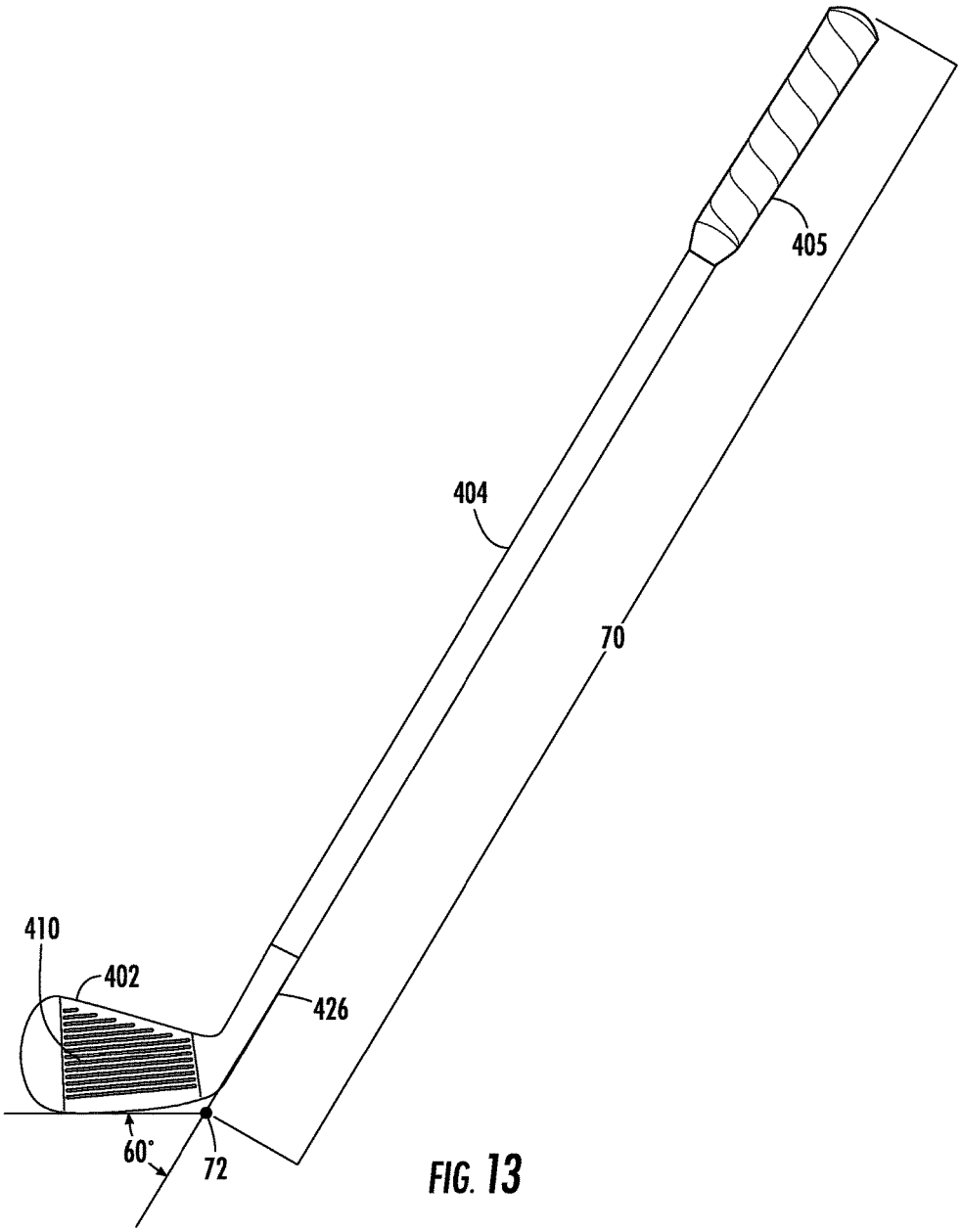
FIG. 13 is a front view of one embodiment of an iron-type golf club according to aspects of the disclosure.

The length 70 of an iron-type golf club 400 can be determined as shown in FIG. 13, by placing the club head 402 with the club set on the horizontal ground plane 6 at the appropriate lie angle 2. The appropriate lie angle for an iron-type golf club head 402 is determined by arranging the sole of the club head 402 on the ground plane 6 where the scorelines on the face are parallel to the ground plane 6. The length 70 of the golf club 400 is the distance from the point of the intersection between the two planes to the end of the grip 405.

As will be discussed in more detail below, the loft angle of the wood-type club heads 202 may vary, e.g., depending on the shot distance desired for the club head 202. For example, a driver golf club head may have a loft angle range of 7 degrees to 16 degrees, a fairway wood golf club head may have a loft angle range of 12 to 26 degrees.

In some embodiments, wood-type heads 202 as described herein may generally have a head weight of about 195 grams to 225 grams, or about 180 grams to 260 grams, or about 260 grams to 280 grams, or about 240 grams to about 280 grams. In some embodiments, wood-type heads 202 as described herein may have a center of gravity CGX in the range of 19 to 28 mm, CGY in the range of 13 to 25 mm, and CGZ in the range of 14 to 35 mm. In some embodiments, wood-type heads 202 as described herein may have a MOI x-x of approximately 1200 to 3000 $g*cm^2$, MOI z-z of approximately 2200 to 5400 $g*cm^2$, and an MOI h-h of approximately 3600 to 8200 $g*cm^2$. In some embodiments, wood-type heads 202 as described herein may have a head length ranging from 95 to 125 mm and a head breadth ranging from 78 to 123 mm. Additionally, in some embodiments, wood-type heads 202 may have a face center 40 defined by a CFX between (where between is defined herein as inclusive) 20 to 32 mm, a CFY between 8 to 18 mm, and a CFZ between 18 to 35 mm. In some embodiments the face height 56 of the wood-type clubs heads 202 may be about 30 to 72 mm, or may be approximately 60 mm+/−0.5 mm in another embodiment. The length of wood-type clubs may be approximately 41 inches or may be within a range of about 40 inches to 42 inches or may be within a range of about 42 inches to 44 inches. In other embodiments wood-type clubs may have a length that may be approximately 40 inches or may be within a range of about of 39 inches to 41 inches. In still other embodiments wood-type clubs may have a length of about 37.5 inches and may be in the range of about 36.5 to about 38.5

Hybrid-Clubs

As discussed above, hybrid-type clubs 300 may also be included in golf club sets 100 as described in this disclosure. Hybrid-type clubs 300, as shown in FIGS. 9-12, may be similar in many respects to wood-type clubs 200 as shown in FIGS. 2-8 including at least the construction and materials used. The same reference numbers are used to show similar portions of hybrid-type clubs 300 in FIGS. 9-12 as used for wood-type clubs 200 in FIGS. 2-8.

Generally hybrid-type clubs, as shown in FIGS. 9-12, refer to clubs having a volume of about 85 cc to about 150 cc with a loft angle of about 16 degrees to about 32 degrees.

In some embodiments, hybrid-type heads as described herein may generally have a head weight of about 240 grams to 280 grams, or about 220 to 290 grams, or about 260 grams to 280 grams. In some embodiments, hybrid-type heads as described herein may have a center of gravity CGX in the range of 20 to 32 mm, CGY in the range of 8 to 20 mm, and CGZ in the range of 13 to 22 mm. In some embodiments, hybrid-type heads as described herein may have a MOI x-x of approximately 800 to 1700 g*cm$^2$, MOI z-z of approximately 2000 to 4800 g*cm$^2$, and an MOI h-h of approximately 3600 to 6500 g*cm$^2$. In some embodiments, hybrid-type heads as described herein may have a head length ranging from 95 to 105 mm and a head breadth ranging from 51 to 73 mm. Additionally, in some embodiments, hybrid type heads may have a face center 40 defined by a CFX between (where between is defined herein as inclusive) 21 to 35 mm, a CFY between 6 to 15 mm, and a CFZ between 16 to 20 mm. In some embodiments the face height 56 of hybrid-type club heads may be about 29 to 40 mm, or may be approximately 35 mm+/−0.5 mm in another embodiment. The length of hybrid-type clubs may be approximately 37.5 inches or may be within a range between 36.5 inches and 38.5 inches. In an alternate embodiment the hybrid-type club has a length that may be approximately 36.5 inches or may be within of 35.5 inches and 37.5 inches.

Iron-Type Clubs

As discussed above, iron-type clubs 400 may also be included in golf club sets 100 as described in this disclosure. An exemplary iron-type club 400 is shown in FIGS. 13-19. Iron-type clubs 400 of this disclosure can include any type of iron-type club including a blade-type golf club which do not contain cavities or depressions in the rear surface and can also include perimeter-weighted clubs which do contain one or more rear cavities. Iron-type golf clubs 400 in accordance with at least some aspects of this invention can include a club head 402, a shaft 404, and a grip member 405 engaged with the shaft 404. While a low loft iron-type golf club head 402 is illustrated in FIGS. 13-19, the set of golf clubs 100 can include many iron-type clubs 400, including, for example: low, middle, and high loft club heads (of any desired loft, e.g., 1-iron, 2-iron, 3-iron, etc. to 9-iron and wedges with loft angles ranging from 20-64 degrees). The iron-type club 400 heads may be made from any desired materials, in any desired construction and/or in any desired manner, including from conventional materials, in conventional constructions, in conventional manners, as are known and/or used in the art, optionally modified (if necessary, e.g., in size, shape, inclusion of structures, etc.) as required for aspects of this invention as described in more detail below.

Any desired materials also may be used for the shaft 404, including conventional materials that are known and/or used in the art, such as steel, graphite based materials, polymers, composite materials, combinations of these materials, etc. The grip member 405 may be engaged with the shaft 404 in any desired manner, including in conventional manners that are known and/or used in the art (e.g., via cements or adhesives, via mechanical connections, etc.). Any desired materials may be used for the grip member 103, including conventional materials that are known and/or used in the art, such as rubber, polymeric materials, cork, rubber or polymeric materials with cord or other fabric elements embedded therein, cloth or fabric, tape, etc.

Figure 14:
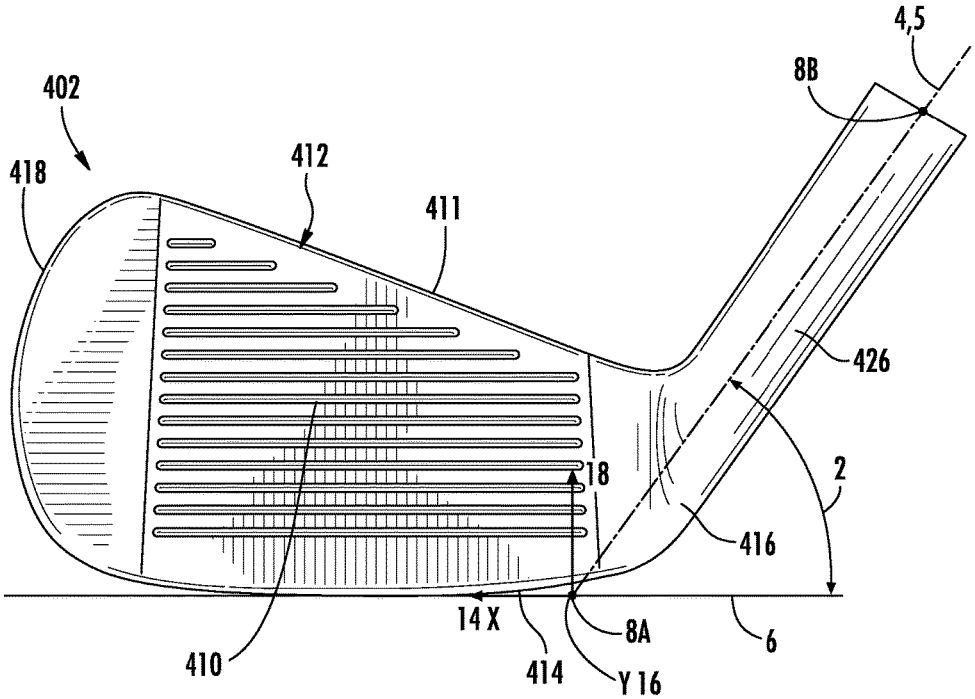
FIG. 14 is a front view of the club head of FIG. 13, showing a ground plane origin point.
Figure 16:
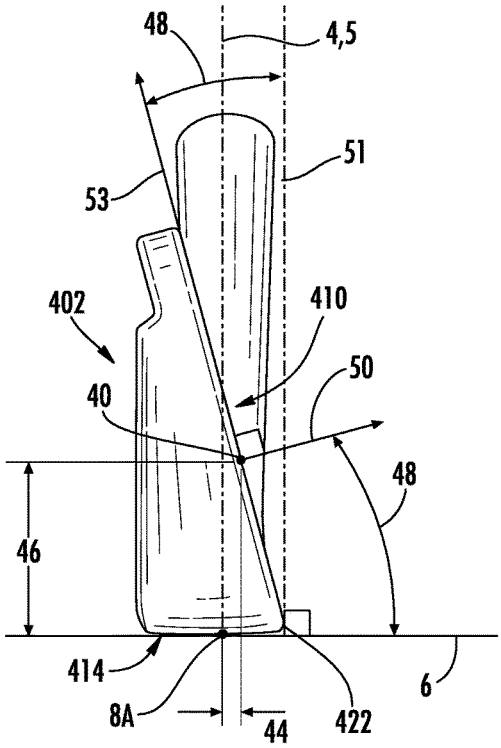
FIG. 16 is a side view of the club head of FIG. 13.
Figure 17:
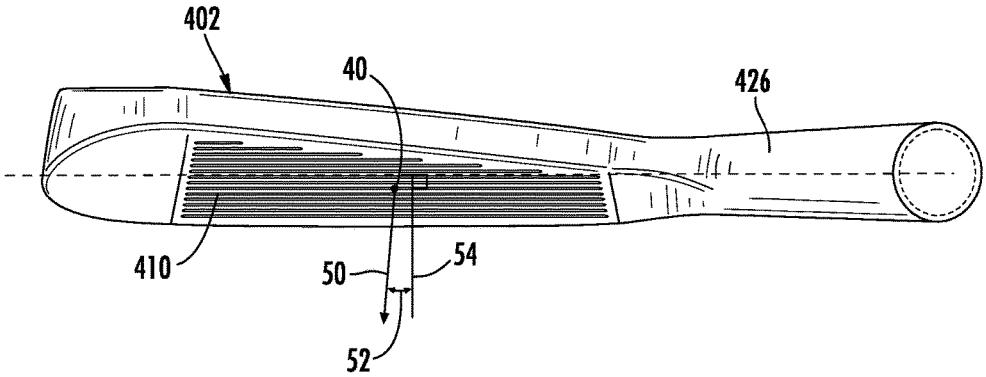
FIG. 17 is a top view of the club head of FIG. 13.
Figure 18:
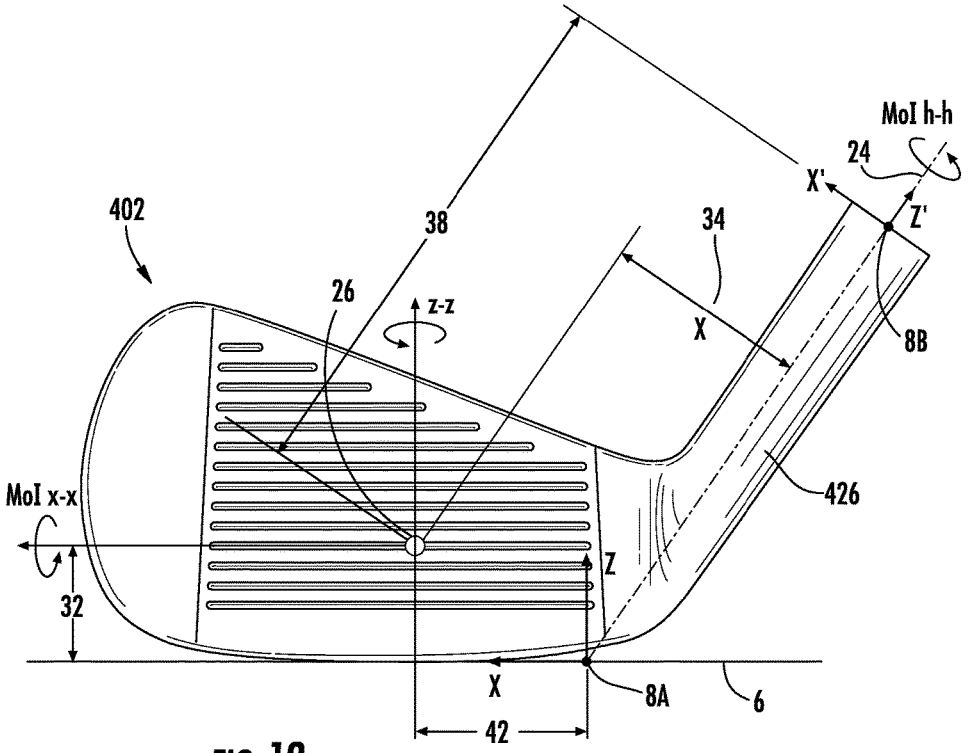
FIG. 18 is a front view of the club head of FIG. 13.
Figure 19:
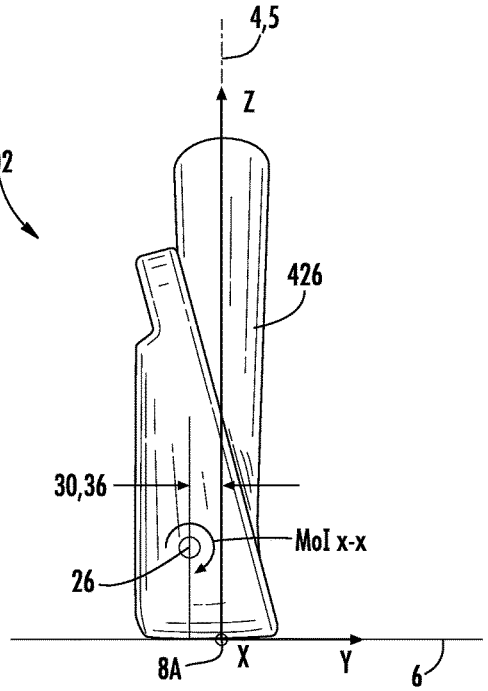
FIG. 19 is a side view of the club head of FIG. 13.

Iron-type club heads 402 include various parts. FIG. 14 illustrates various parts of the golf club head 402 as will be referenced throughout the remainder of this application (as referenced from USGA Rules of Golf). An iron club head 402 has a face or striking face 410, a body 411, a top surface 412, a sole 414, a heel 416, a toe 418, and a rear surface 420. The top surface 412 may be defined as the upper portion of the head 402. The sole 414 may be defined as the bottom or underside portion of the head 402, and is generally opposite the top surface 412. The sole 414 may include an area on the club head 402 that rests on the ground when a golfer soles the iron-type golf club 400. The sole 414 may generally rest on a ground plane 6, wherein the ground plane 6 is a horizontal plane tangent with the bottom of the club head 402. The heel 416 may be the part of the club head 402 nearer to and including a hosel 426. The toe 418 may be the area of the iron-type golf club 400 that is the farthest from the shaft 404. The rear surface 420 of the club head 402 is generally opposite the face 410. The shaft 404 attaches to the head 402 at the heel 416 via a hosel 426. FIG. 16 illustrates an example of a leading edge 422 of iron-type golf club head 402. The leading edge 422 is the forward most surface connecting the sole 414 and the striking face 410. The leading edge 422 may be a constant radius or may have a curvature that changes along the heel to the toe of the golf club head.

Similar to the wood-type 200 and hybrid-type 300 golf clubs described herein, the various embodiments of iron-type golf clubs 400 and/or golf club heads 402 described herein may include components that have sizes, shapes, locations, orientations, etc., that are described with reference to one or more properties and/or reference points. The same reference numbers are used to show similar portions of iron-type clubs 200 in FIGS. 13-19 as used for wood-type clubs 200 in FIGS. 2-8. Similarly, the face center location 40 is the point on the striking surface 210 where the crown to sole measurements on the template are equidistant, and the heel to toe measurements are equidistant. For iron-type clubs 400, the heel and toe measurement is made at the edges of the roughened area of the face.

Figure 15:
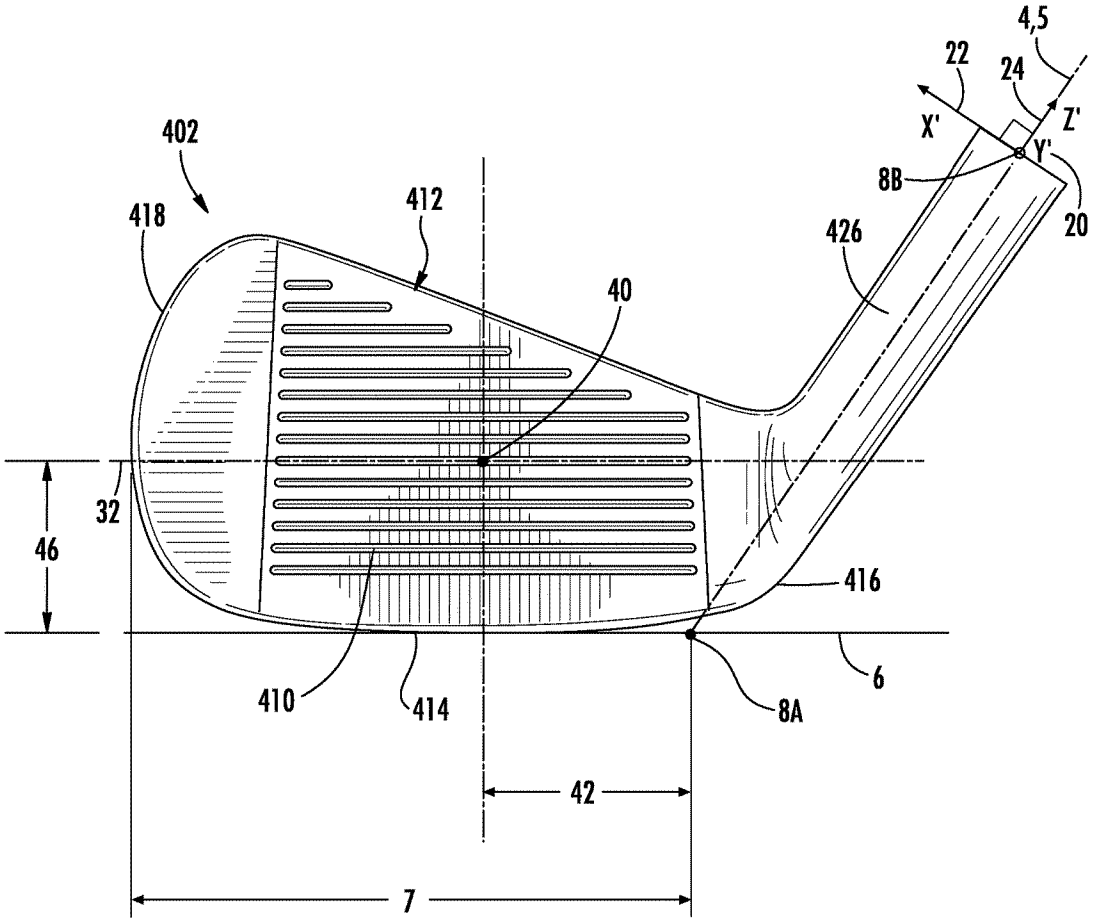
FIG. 15 is a front view of the club head of FIG. 13, showing a hosel origin point.

As shown in FIG. 14 an origin point 8 may be defined on the iron-type golf club 400 or golf club head 402, or a point defined in relation to certain elements of the club or head. Similar to the wood-type 200 and hybrid-type 300 clubs, various other points, such as the center of gravity, sole contact, and face center, may be described and/or measured in relation to the origin point 8. FIG. 14 illustrates two different examples of where the origin point 8 may be located. A first location 8A, defined as a ground origin point 8A, is generally located at the ground plane 6. The ground origin point 8A is defined as the point at which the ground plane 6 and the hosel axis 4, 5 intersect. The second location 8B, defined as the hosel origin point 8B, is generally located on the hosel 426. The hosel origin point 8B is located on the hosel axis 4,5 and coincident with the uppermost edge of the hosel 426. Either location for the origin point 8 may be utilized without departing from this invention. Additionally, other locations for the origin point 8 may be utilized without departing from this invention. Throughout the remainder of this application, the ground origin point 8A will be utilized for all reference locations, tolerances, and calculations for iron-type golf clubs 400. The head length 7 of an iron-type club 400 may be measured from the ground origin point 8A to the furthest point on the toe 418 as shown in FIG. 15.

In some embodiments, iron-type heads 402 as described herein may generally have a head weight of about 240 to 280 grams, or about 230 grams to 290 grams, or about 260 grams to about 280 grams. In some embodiments, iron-type heads 402 as described herein may have a center of gravity CGX in the range of 20 to 26 mm, CGY in the range of 8 to 20 mm, and CGZ in the range of 13 to 35 mm. In some embodiments, iron-type heads 402 as described herein may have a MOI x-x of approximately 500 to 1200 g*cm$^2$, MOI z-z of approximately 2000 to 3400 g*cm$^2$, and an MOI h-h of approximately 5000 to 7100 g*cm$^2$. In some embodiments, iron-type heads 402 as described herein may have a head length 7 ranging from 60 to 85 mm. Additionally, in some embodiments, iron-type heads 402 may have a face center 40 defined by a CFX between (where between is defined herein as inclusive) 28 to 38 mm, a CFY between 6 to 17 mm, and a CFZ between 17 to 35 mm. The length of the iron-type clubs may be approximately 37.5 inches or may be within a range between 36.5 inches and 38.5 inches. In other embodiments iron-type clubs may have a length that may be approximately 36.5 inches or may be within of 35.5 inches and 37.5 inches. In still other embodiments iron-type clubs may have a length of about 37.5 inches and may be in the range of about 36.5 to about 38.5

Set of Golf Clubs

Referring now to FIGS. 1A-1F, a set of golf clubs 100 can include any number golf clubs and can include any number of different types of golf clubs including wood-type golf clubs 200, including fairway woods, hybrid-type clubs 300, iron-type clubs 400, and putters. As described here, clubs within a set of clubs 100 can have similar characteristics between the clubs.

A set of golf clubs 100 as described herein can include one or more wood-type clubs 200. As described above, each wood-type club 200 within a set of golf clubs 100 may include a striking face 212, a body 208, the body having a crown 216, a sole 218, a heel 220, a toe 222, and a hosel 209 including a hosel axis 4,5. Each of the wood-type clubs 200 within a set of golf clubs 100 may also include a shaft 204.

As described above, each of the wood-type clubs 200 has a length 70, a lie angle 2, a weight, a swing weight, and a center of gravity 26. As described above each of the wood-type clubs 200 within a set of clubs 100 also includes a ground plane origin point 8A located at the point at which a ground plane 6 and the hosel axis 4,5 intersect.

In some embodiments, each of the wood-type clubs 200 within a set of clubs 100 can have a loft angle 48 in the range of 7 degrees to 26 degrees. In some embodiments, a set of golf clubs 100 can include a first wood-type club having a loft angle 48 in the range of 7 degrees to 18 degrees, a second wood-type club having a loft angle 48 in the range of 15 degrees to 22 degrees; and a third wood-type club having a loft angle 48 in the range of 19 degrees to 26 degrees. In other embodiments, a set of golf clubs 100 according to this disclosure can have any number of wood-type clubs 200 each having any loft angle 48.

Similarly, a set of golf clubs 100 as described herein can include one or more hybrid-type clubs 300. As described above, each hybrid-type club 300 within a set of golf clubs 100 may include a striking face 212, a body 208, the body having a crown 216, a sole 218, a heel 220, a toe 222, and a hosel 209 including a hosel axis 4,5. Each of the hybrid-type clubs 300 within a set of golf clubs 100 may also include a shaft 204.

As described above, each of the hybrid-type clubs 300 has a length 70, a lie angle 2, a weight, a swing weight, and a center of gravity 26. As described above each of the hybrid-type clubs 300 within a set of clubs 100 also includes a ground plane origin point 8A located at the point at which a ground plane 6 and the hosel axis 4,5 intersect.

In some embodiments, each of the hybrid-type clubs 300 within a set of clubs 100 can have a loft angle 48 in the range of 21 degrees to 32 degrees. In some embodiments, a set of golf clubs 100 can include a first hybrid-type club having a loft angle 48 in the range of 21 degrees to 26 degrees; and a second hybrid-type club having a loft angle 48 in the range of 25 degrees to 32 degrees. In other embodiments, a set of golf clubs 100 according to this disclosure can have any number of hybrid-type clubs 300 each having any loft angle 48.

Similarly, a set of golf clubs 100 as described herein can include one or more iron-type clubs 400. As described above, each iron-type club 400 within a set of golf clubs 100 may include a striking face 410, a body 411, the body having a top surface 412, a sole 414, a heel 416, a toe 418, and a hosel 426 including a hosel axis 4,5. Each of the iron-type clubs 400 within a set of golf clubs 100 may also include a shaft 404.

As described above, each of the iron-type clubs 400 has a length 70, a lie angle 2, a weight, a swing weight, and a center of gravity 26. As described above each of the iron-type clubs 400 within a set of clubs 100 also includes a ground plane origin point 8A located at the point at which a ground plane 6 and the hosel axis 4,5 intersect.

In some embodiments, each of the iron-type clubs 400 within a set of clubs 100 can have a loft angle 48 in the range of 23 degrees to 60 degrees. In some embodiments, a set of golf clubs 100 can include a first iron-type club having a loft angle 48 in the range of 32 degrees to 38 degrees, a second iron-type club having a loft angle 48 in the range of 36 degrees to 42 degrees, a third iron-type club having a loft angle 48 in the range of 40 degrees to 46 degrees, a fourth iron-type club having a loft angle 48 in the range of 44 degrees to 50 degrees, a fifth iron-type club having a loft angle 48 in the range of 48 degrees to 54 degrees, and a sixth iron-type club having a loft angle 48 in the range of 53 degrees to 60 degrees. In other embodiments, a set of golf clubs 100 according to this disclosure can have any number of iron-type clubs 400 each having any loft angle 48.

In some embodiments, each of the iron-type clubs 400 within a set of clubs 100 can have a loft angle 48 in the range of 23 degrees to 60 degrees. In some embodiments, a set of golf clubs 100 can include a first iron-type club having a loft angle 48 in the range of 28 degrees to 34 degrees, a second iron-type club having a loft angle 48 in the range of 32 degrees to 38 degrees, a third iron-type club having a loft angle 48 in the range of 36 degrees to 42 degrees, a fourth iron-type club having a loft angle 48 in the range of 40 degrees to 46 degrees a fifth iron-type club having a loft angle 48 in the range of 44 degrees to 50 degrees, a sixth iron-type club having a loft angle 48 in the range of 48 degrees to 54 degrees, and a seventh iron-type club having a loft angle 48 in the range of 53 degrees to 60 degrees. In other embodiments, a set of golf clubs 100 according to this disclosure can have any number of iron-type clubs 400 each having any loft angle 48.

As described above, the golf clubs within a set of clubs 100 can have similar properties or characteristics. For example, in some embodiments, each club within a set of clubs 100 can have similar properties. In other examples, certain clubs within a set of clubs can have certain properties or characteristics while other clubs have different properties or characteristics. In one example, wood-type clubs 200 can have similar properties as hybrid-type clubs 300 and in another example hybrid-type clubs 300 can have similar properties to iron-type clubs 400. These properties can include, for example, length, weight, lie angle, swing weight, center of gravity location, and moment of inertia.

For example, in some embodiments, each of the golf clubs within a set of clubs 100 can have a substantially similar weight. This weight may be approximately 270 grams, or in a range of about 260 to about 280 grams, or in a range of 240 to about 280 grams. Similarly, for example, each golf club within a set of golf clubs 100 can have a substantially similar length 70 which may be approximately 37.5 inches and may be in the range of about 36.5 to about 38.5 inches, and/or a substantially similar lie angle which may be in the range of about 60 to about 63 degrees. Additionally, in some embodiments, each of the clubs within a set of golf clubs 100 may also have a substantially similar swing weight. As described above, in a set of clubs 100 each of these properties or characteristics can also or alternatively be similar between types of clubs such as wood-type clubs 200, hybrid-type clubs 300, and iron-type clubs 400.

Similarly, each club within a set of golf clubs 100 can have a center of gravity 26 located at substantially the same position relative to the ground plane origin point 8A of each club within the set of golf clubs, and in other embodiments, each club within a set of golf clubs 100 can have a center of gravity 26 located at substantially the same position along a particular axis (x-axis, y-axis, and/or z-axis) relative to the ground plane origin point 8A of each club within the set of golf clubs. In other embodiments, each club within a set of golf clubs 100 can have a center of gravity 26 located at within about 2 mm or within about 5 mm of each other club within the set of golf clubs 100 relative to the ground plane origin point 8A. In still other embodiments, each club within a set of golf clubs 100 can have a center of gravity 26 located at within about 2 mm or within about 5 mm of each other club within the set of golf clubs 100 relative to the ground plane origin point 8A of each club within the set of golf clubs 100 in a particular direction such as the x-axis direction, the y-axis direction, and/or the z axis direction. As described above, in a set of clubs 100, each of these properties or characteristics can also be similar between types of clubs such as wood-type clubs, hybrid-type clubs, and iron-type clubs. For example, in some embodiments, the distance between the center of gravity and the ground plan origin point 8A of at least one wood-type club 200 in a y-axis direction may be substantially similar to a distance between a center of gravity and the ground plane origin point of at least one hybrid-type club 300 in the y-axis direction within a set of golf clubs 100. In other embodiments, the distance between a center of gravity and the ground plane origin point of at least one hybrid-type club in a y-axis direction may be substantially similar to the distance between a center of gravity and the ground plane origin point of at least one iron-type club in the y-axis direction within a set of golf clubs 100.

As described above, each club within the set of clubs may be designed to promote a similar feel to a golfer, and each club head may have a substantially similar center of gravity position relative to the hosel or shaft axis. The center of gravity location can be expressed by the ratio of ΔX 34 to ΔY 36. This ratio may be representative of the effect of center of gravity as to the loading contributed to the club head forces on the shaft generated by the golfer's swing. A club set 100 having a consistent ratio within the set of clubs 100 may promote each club to responding in a similar manner to a golfer's swing which may make a generate a swing with more repeatable results. The ratio of ΔX 34 to ΔY 36 may be approximately 2.8, or may be within a range of about 2.9 to 2.7, or may be within a range of about 3.0 to 2.6.

Additionally, each club within a set of golf clubs 100 may have a moment of inertia that is substantially similar to each club within the set of golf clubs 100. For example, in some embodiments, each club within a set of clubs 100 may have a moment of inertia through the center of gravity with respect to a hosel axis, x-axis, y-axis, and/or z-axis that is substantially the same, or within about 200 g*cm^2 of each other, within the set of clubs 100. In other embodiments, each of the wood-type clubs 200 within a set of clubs 100 can have a moment of inertia through the center of gravity with respect to the hosel axis, x-axis, y-axis, and/or z-axis that is substantially the same, or within about 200 g*cm^2 of each other, for each of the wood-type clubs 200 within the set of clubs 100. Similarly, for example in some embodiments, each of the hybrid-type clubs 300 within a set of clubs 100 can have a moment of inertia through the center of gravity with respect to the hosel axis, x-axis, y-axis, and/or z-axis that is substantially the same, or within about 200 g*cm^2 of each other, for each of the hybrid-type clubs 300 within the set of clubs 100. Additionally, for example in some embodiments, each of the iron-type clubs 400 within a set of clubs 100 can have a moment of inertia through the center of gravity with respect to the hosel axis, x-axis, y-axis, and/or z-axis that is substantially the same, or within about 200 g*cm^2 of each other, for each of the iron-type clubs 400 within the set of clubs 100. For example, in one embodiment, at least one hybrid-type golf club head may have a moment of inertia through the center of gravity with respect to an x-axis that is within 200 g*cm^2 of a moment of inertia through the center of gravity with respect to the x-axis of at least one iron-type golf club head within a set of golf clubs 100. In other embodiments, at least one hybrid-type golf club head may have a moment of inertia through the center of gravity with respect to an z-axis that is within 200 g*cm^2 of a moment of inertia through the center of gravity with respect to the z-axis of at least one iron-type golf club head within a set of golf clubs 100.

As described above an aspect of promoting a consistently swinging set of golf clubs 100 may also be golf club heads having a substantially similar moment of inertia when taken around the hosel axis. Such a set of golf club heads may have a moment of inertia around the hosel axis of approximately 7,400 g*cm^2, or within a range of 7,200 g*cm^2 to 7,600 g*cm^2, or within a range of 7,000 g*cm^2 to 7,800 g*cm^2.

Other properties of a golf club set 100 may also promote a consistently swinging set of golf clubs 100. In some embodiments, for example, each of the clubs within a set of golf clubs 100 can have a grip 205, 405, measured along the shaft, that is substantially the same length. In other embodiments, golf clubs within a set of golf clubs 100 can have a grip 205, 405 that has a length that varies between the clubs. For example, clubs having a higher loft may have longer grip length than clubs having a lower loft which can provide for more versatility in its usage as in chip and pitch shots. A set of golf clubs 100 may also include a first grip length for clubs having a higher loft and a second grip length for clubs having a lower loft.

In other embodiments, golf clubs within the set of golf clubs can have other characteristics that are similar or vary between each club. As discussed above, each of the clubs within a set of golf clubs can have a distance CGZ 32 from the ground plane origin point 8A along the Z-axis 18 to the center of gravity 26 that is constant for each club within the set of clubs. In other embodiments, golf clubs within a set of golf clubs 100 can have a distance CGZ 32 that varies between clubs. For example, in some embodiments the CGZ 32 may increase between clubs as the loft angle 48 increases.

Golf club sets 100 as described herein may also include consistent gapping between each club within the set of clubs. Gap distance generally refers to the difference in carry distance (or distance traveled in the air) between a first club when it hits a ball and the carry distance of the next most similarly lofted club when it hits a ball when the clubs are swung at generally the same speed. Thus, for example, a user may hit a 7-iron 150 yards and hit a 6-iron 160 yards; the gap distance between the clubs in this example would be 10 yards. Thus, golf clubs sets 100 as described herein may include consistent gap distances between each club within a set of clubs 100. For a set of clubs 100 the gap distance between a first club having a first loft and a second club having a second loft may be the same as the gap distance between the second club having the second loft and a third club having a third loft. The gap distance may be substantially the same between each club within a set of clubs 100 and the club within the set of clubs having the next higher loft. In other examples, the gap distance between clubs may have a tolerance or variance of 1 yard of each other or up to 3 yards of each other.

Golf club sets 100 as described herein may also include clubs having varying face thicknesses. In some golf club sets 100, for example, clubs within the set having a lower loft may have a thinner face thickness than clubs within the set 100 having a higher loft. For example, within a set of golf clubs 100, iron-type clubs 400 may have varying face thicknesses. In some such golf club sets 100, there may be a one, two, or three different face thicknesses or each club may have a different face thickness than all other clubs within the set. In some examples, there may be at least a first iron-type type golf club 400 having a first face thickness and a second iron-type golf club 400 having a second face thickness wherein the loft of the first iron-type club is less than the loft of the second iron-type club and the face thickness of the first iron-type club is less than the face thickness of the second iron-type club.

Benefits

Embodiments of this disclosure present many benefits to the golf industry and the different participants in the golf industry.

For example, a golfer, particularly, a beginning golfer may be able to learn the sport of golf more quickly if they learn a small number of different swings that can be repeated with each golf club in their set of golf clubs. This eliminates the difficulty of learning at least 12 different swings and may allow the golfer to attain more consistent results.

As described above, because each clubs within a set of golf clubs 100 may have similar characteristics it may be easier for a beginning golfer to learn the sport of golf. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A set of golf clubs comprising:

a plurality of hybrid-type golf clubs, each hybrid-type golf club comprising:

a hybrid-type golf club head having a striking face configured for striking a ball and a body extending rearwardly from the striking face, the body having a crown, a sole, a heel, and a toe, and a hosel including a hosel axis;

a shaft configured to engage with the hybrid-type golf club head at a first end and a grip engaged with the shaft at a second end opposite the first end;

wherein each of the plurality of hybrid-type golf clubs has a first length, a first lie angle, a first weight, a first swing weight, and a first center of gravity;

wherein each of the plurality of hybrid-type clubs include a hybrid-type golf club ground plane origin point located at the point at which a ground plane and the hosel axis intersect; and wherein each of the plurality of hybrid-type clubs has a loft angle in the range of 21 degrees to 32 degrees and wherein the hybrid-type club head has a hollow portion and a volume within a range of 85 cc to 150 cc;

a plurality of iron-type golf clubs, each iron-type golf club comprising:

an iron-type golf club head having a striking face configured for striking a ball and a body extending rearwardly from the striking face, the body having a top surface, a sole, a heel, and a toe, and a hosel including a hosel axis, wherein the iron-type club head is perimeter-weighted and includes a rear cavity;

a shaft configured to engage with the iron-type golf club head at a first end and a grip engaged with the shaft at a second end opposite the first end;

wherein each of the plurality of iron-type golf clubs has a second length, a second lie angle, a second weight, a second swing weight, and a second center of gravity;

wherein each of the plurality of iron-type clubs include an iron-type golf club ground plane origin point located at the point at which the ground plane and the hosel axis intersect; and wherein each of the plurality of iron-type clubs has a loft angle in the range of 23 degrees to 60 degrees;

wherein the first, and second lengths are substantially equal; and wherein the first, and second lie angles are substantially equal; and wherein a distance between the first center of gravity and the hybrid-type golf club ground plane origin point in a y-axis direction is within 2 mm of a distance between the second center of gravity and the iron-type golf club ground plane origin point in the y-axis direction;

wherein each of the plurality of hybrid-type golf club heads have a first moment of inertia with respect to the hosel axis;

wherein each of the plurality of iron-type golf club heads have a second moment of inertia with respect to the hosel axis; and wherein the first and second moment of inertia are within 200 $g*cm^2$ of each other.

2. The set of claim 1, wherein each of the plurality of hybrid-type golf club heads have a first moment of inertia parallel to a z-axis through the center of gravity;

wherein each of the plurality of iron-type golf club heads have a second moment of inertia parallel to a z-axis through the center of gravity; and wherein the first and second moment of inertia are within 200 $g*cm^2$ of each other.

3. The set of claim 1, wherein each of the plurality of hybrid-type golf club heads have a first ratio of a center of gravity location measured from a hosel origin point $\Delta X$ to $\Delta Y$;

wherein each of the plurality of iron-type golf club heads have a second ratio of a center of gravity location measured from a hosel origin point $\Delta X$ to $\Delta Y$; and wherein the first ratio and the second ratio are within a range of 2.6 to 3.0.

4. A set of golf clubs comprising:

a plurality of hybrid-type golf clubs, each hybrid-type golf club comprising:

a hybrid-type golf club head having a striking face configured for striking a ball and a body extending rearwardly from the striking face, the body having a crown, a sole, a heel, and a toe, and a hosel including a hosel axis;

a shaft configured to engage with the hybrid-type golf club head at a first end and a grip engaged with the shaft at a second end opposite the first end;

wherein each of the plurality of hybrid-type golf clubs has a first length, a first lie angle, a first weight, a first swing weight, and a first center of gravity;

wherein each of the plurality of hybrid-type clubs include a hybrid-type golf club ground plane origin point located at the point at which a ground plane and the hosel axis intersect; and wherein a first hybrid-type golf club has a loft angle within a range of 21 to 26 degrees, and a second hybrid-type golf club has a loft angle within a range of 25-32 degrees and wherein the hybrid-type club head has a hollow portion and a volume within a range of 85 cc to 150 cc;

a plurality of iron-type golf clubs, each iron-type golf club comprising:

an iron-type golf club head having a striking face configured for striking a ball and a body extending rearwardly from the striking face, the body having a top surface, a sole, a heel, and a toe, and a hosel including a hosel axis, wherein the iron-type club head is perimeter-weighted and includes a rear cavity;

a shaft configured to engage with the iron-type golf club head at a first end and a grip engaged with the shaft at a second end opposite the first end;

wherein each of the plurality of iron-type golf clubs has a second length, a second lie angle, a second weight, a second swing weight, and a second center of gravity;

wherein each of the plurality of iron-type clubs include an iron-type golf club round plane origin point located at the point at which the ground plane and the hosel axis intersect; and wherein a first iron-type club has a loft angle in the range of 32 degrees to 38 degrees; a second iron-type club has a loft angle in the range of 36 degrees to 42 degrees; a third iron-type club has a loft angle in the range of 40 degrees to 46 degrees; and a fourth iron-type club has a loft angle in the range of 44 degrees to 50 degrees;

wherein the first and second lengths are substantially equal; and wherein the first and second lie angles are substantially equal; and wherein each of the plurality of hybrid-type golf club heads has a first moment of inertia with respect to the hosel axis within a range of 7,000 $g*cm^2$ and 7,800 $g*cm^2$ and wherein each of the iron-type golf club heads has a second moment of inertia with respect to the hosel axis within a range of 7,000 $g*cm^2$ and 7,800 $g*cm^2$.

5. The set of claim 4, wherein a distance between the first center of gravity and the hybrid-type golf club ground plane origin point in a y-axis direction is within 2 mm of a distance between the second center of gravity and the iron-type golf club ground plane origin point in the y-axis direction.

6. The set of claim 4, wherein each of the plurality of hybrid-type golf club heads have a first moment of inertia with respect to the hosel axis within a range of 7,200 $g*cm^2$ and 7,600 $g*cm^2$ and wherein each of the plurality of iron-type golf club heads have a second moment of inertia with respect to the hosel axis within a range of 7,200 $g*cm^2$ and 7,600 $g*cm^2$.

7. The set of claim 4, wherein each of the plurality of hybrid-type golf club have a first ratio of a center of gravity location measured from a hosel origin point $\Delta X$ to $\Delta Y$;

wherein each of the plurality of iron-type golf club heads have a second ratio of a center of gravity location measured from a hosel origin point $\Delta X$ to $\Delta Y$; and wherein the first ratio and the second ratio are within a range of 2.7 to 2.9.

* * * * *